US006779657B2

(12) United States Patent
Mainwaring et al.

(10) Patent No.: US 6,779,657 B2
(45) Date of Patent: Aug. 24, 2004

(54) SINGLE-USE APPLICATORS, DISPENSERS AND METHODS FOR POLYMERIZABLE MONOMER COMPOUND

(75) Inventors: Lawrence H. Mainwaring, Raleigh, NC (US); Upvan Narang, Raleigh, NC (US)

(73) Assignee: Closure Medical Corporation, Raleigh, NC (US)

( * ) Notice: Subject to any disclaimer, the term of this patent is extended or adjusted under 35 U.S.C. 154(b) by 211 days.

(21) Appl. No.: 09/874,039

(22) Filed: Jun. 6, 2001

(65) Prior Publication Data

US 2002/0185396 A1 Dec. 12, 2002

(51) Int. Cl.[7] ..... B65D 69/00

(52) U.S. Cl. ..... 206/229; 206/209; 206/15.3; 206/438

(58) Field of Search ..... 206/209, 229, 206/230, 361, 362, 362.3, 15.3, 438, 570, 63.5; 401/123, 132, 133; 604/1–3; 428/34.1, 34.2, 35.7

(56) References Cited

U.S. PATENT DOCUMENTS

| | | | |
|---|---|---|---|
| 1,332,985 | A | 3/1920 | Jarrett |
| 1,962,875 | A | 6/1934 | Reber |
| 2,133,122 | A | 10/1938 | Swain |
| 2,705,579 | A | 4/1955 | Mason |

(List continued on next page.)

FOREIGN PATENT DOCUMENTS

| | | |
|---|---|---|
| GB | 2 107 328 A | 4/1983 |
| WO | WO 00/12411 | 3/2000 |
| WO | WO 00/38777 | 7/2000 |

OTHER PUBLICATIONS

U.S. patent application Ser. No. 08/266,647, Clark et al., filed Jun. 1994.

U.S. patent application Ser. No. 08/488,411, Leung, filed Jun. 1995.

(List continued on next page.)

*Primary Examiner*—Luan K. Bui
(74) *Attorney, Agent, or Firm*—Oliff & Berridge, PLC

(57) ABSTRACT

A single-use applicator assembly for dispensing and applying a polymerizable monomeric adhesive material includes: a base portion having at least one sealed compartment; a polymerizable monomeric adhesive material contained in the compartment; an applicator at least partially disposed in the compartment such that a tip of the applicator is proximate the adhesive material. The at least one sealed compartment may comprise first and second sealed compartments that are separated with the polymerizable monomeric adhesive material contained in the first compartment and the applicator at least partially disposed in the second compartment. Alternatively, the first and second compartments may be open to each other. In such case, the applicator assembly may further comprise a plunger that defines the second compartment and that is movable into the first compartment to displace the adhesive material into the second compartment. A kit can include multiple applicator assemblies that are separate or frangibly connected.

51 Claims, 12 Drawing Sheets

U.S. PATENT DOCUMENTS 2,721,858 A 10/1955 Joyner et al.
3,254,111 A 5/1966 Hawkins et al.
3,450,129 A 6/1969 Avery et al.
3,495,917 A 2/1970 Truhan
3,519,364 A 7/1970 Truhan
3,520,306 A 7/1970 Gardner et al.
3,524,537 A 8/1970 Winter
3,559,652 A 2/1971 Banitt et al.
3,573,069 A 3/1971 Keller et al.
3,728,375 A 4/1973 Coover, Jr. et al.
3,730,337 A 5/1973 White
3,759,375 A * 9/1973 Nappi ..... 206/361
3,786,820 A 1/1974 Kopfer
3,789,820 A 2/1974 Douglas et al.
3,835,834 A 9/1974 Brown et al.
3,940,362 A 2/1976 Overhults
3,970,505 A 7/1976 Hauser et al.
3,995,641 A 12/1976 Kronenthal et al.
4,014,748 A 3/1977 Spinner et al.
4,138,014 A 2/1979 Bouman
4,206,843 A 6/1980 Rainey
4,211,323 A 7/1980 Olsen
4,297,160 A 10/1981 Kusayama et al.
4,313,865 A 2/1982 Teramoto et al.
4,340,708 A 7/1982 Gruber
4,364,876 A 12/1982 Kimura et al.
4,430,013 A 2/1984 Kaufman
4,560,723 A 12/1985 Millet et al.
4,648,532 A 3/1987 Green
4,690,676 A 9/1987 Moulding, Jr. et al.
4,707,450 A 11/1987 Nason
4,720,513 A 1/1988 Kameyama et al.
4,747,719 A 5/1988 Parkin
4,777,230 A 10/1988 Kamath
4,781,696 A 11/1988 Moulding, Jr. et al.
4,826,047 A 5/1989 Heflin
4,844,251 A 7/1989 Gueret
4,877,036 A 10/1989 Saint-Amand
4,880,111 A 11/1989 Bagwell et al.
4,903,708 A 2/1990 Saint-Amand
4,930,637 A 6/1990 DeRoseau
4,944,427 A 7/1990 Yamada et al.
4,972,969 A 11/1990 Randklev
5,016,651 A 5/1991 Stalcup et al.
5,038,938 A 8/1991 Berndt
5,042,690 A 8/1991 O'Meara
5,066,299 A 11/1991 Bellingham
5,130,369 A 7/1992 Hughes et al.
5,167,973 A 12/1992 Snyder
5,203,459 A 4/1993 Wade
5,216,096 A 6/1993 Hattori et al.
5,232,774 A 8/1993 Otsuka et al.
5,259,835 A 11/1993 Clark et al.
5,277,920 A 1/1994 Weaver, Jr.
5,292,333 A 3/1994 Johnson
5,328,687 A 7/1994 Leung et al.
5,456,361 A 10/1995 Walsh et al.
5,490,736 A 2/1996 Haber et al.
5,514,371 A 5/1996 Leung et al.
5,514,372 A 5/1996 Leung et al.
5,562,705 A 10/1996 Whiteford
5,569,302 A 10/1996 Proto et al.
5,582,834 A 12/1996 Leung et al.
5,624,669 A 4/1997 Leung et al.
5,636,931 A 6/1997 Gueret
5,660,273 A 8/1997 Discko, Jr.
5,727,679 A 3/1998 Newarski
5,757,997 A 5/1998 Birrell et al.
5,779,053 A 7/1998 Partika et al.
5,782,568 A 7/1998 Roder et al.
5,794,774 A 8/1998 Porcelli
5,803,638 A 9/1998 Gueret
5,928,611 A * 7/1999 Leung ..... 422/131
5,947,296 A 9/1999 Castora
5,979,658 A 11/1999 Allen et al.
5,986,246 A 11/1999 Lee
5,989,205 A 11/1999 Pond et al.
6,010,462 A 1/2000 Stoermer, III
6,012,586 A 1/2000 Misra
6,085,907 A 7/2000 Hochmeister et al.
6,105,761 A 8/2000 Peuker et al.
6,116,414 A 9/2000 Discko, Jr.
6,186,971 B1 2/2001 Naughton
6,206,192 B1 3/2001 Winstead et al.
6,213,767 B1 4/2001 Dixon et al.
6,216,885 B1 4/2001 Guillaume
6,217,603 B1 4/2001 Clark et al.
6,228,324 B1 5/2001 Hasegawa et al.
6,283,933 B1 9/2001 D'Alessio et al.
6,305,541 B1 10/2001 Tanner et al.
6,312,258 B1 11/2001 Ashman
6,329,564 B1 12/2001 Lebner
6,340,097 B1 1/2002 D'Alessio et al.
6,341,694 B1 1/2002 Dawood
6,372,313 B1 * 4/2002 D'Alessio et al. ..... 206/229
6,412,639 B1 * 7/2002 Hickey ..... 206/570
6,447,476 B1 9/2002 Sogaro
6,503,013 B2 * 1/2003 Strauss ..... 401/132
6,620,846 B1 * 9/2003 Jonn et al. ..... 514/519
2002/0066686 A1 6/2002 Montenieri et al.

OTHER PUBLICATIONS

U.S. patent application Ser. No. 08/920,876, Clark et al., filed Aug. 1997.
U.S. patent application Ser. No. 09/025,472, Hickey et al., filed Feb. 1998.
U.S. patent application Ser. No. 09/069,875, Narang, filed Apr. 1998.
U.S. patent application Ser. No. 09/069,979, Narang et al., filed Apr. 1998.
U.S. patent application Ser. No. 09/099,457, Malofsky et al., filed Jun. 1998.
U.S. patent application Ser. No. 09/374,207, Hickey et al., filed Aug. 1999.
U.S. patent application Ser. No. 09/385,030, D'Alessio et al., filed Aug. 1999.
U.S. patent application Ser. No. 09/430,176, Narang et al., filed Oct. 1999.
U.S. patent application Ser. No. 09/430,177, Narang et al., filed Oct. 1999.
U.S. patent application Ser. No. 09/430,180, Nicholson et al., filed Oct. 1999.
U.S. patent application Ser. No. 09/430,289, D'Alessio et al., filed Oct. 1999.
U.S. patent application 09/471,392, Narang et al., filed Dec. 1999.

* cited by examiner

SINGLE-USE APPLICATORS, DISPENSERS AND METHODS FOR POLYMERIZABLE MONOMER COMPOUND

BACKGROUND OF THE INVENTION

This invention relates to single use applicators and/or dispensers for applying a polymerizable monomer compound such as cyanoacrylate adhesives, particularly for medical use. The present invention also relates to packaging systems for such applicators.

Numerous swabs, applicators, dispensers and kits for dispensing and applying various materials, including adhesive materials, are known. However, these known arrangements possess various shortcomings that make them undesirable in many applications.

For example, U.S. Pat. No. 5,660,273 to Discko, Jr. discloses a package having wells or depressions for holding a medicament or material and an applicator for applying the medicament or material. The package includes a tray and a cover extending over the entire top surface of the tray. The tray includes an applicator well and a separate medicament well. A mixing area is placed on the cover. The tray further includes medicament wells and an applicator well. However, the '273 patent does not address providing effective storage and application of a polymerizable monomer compound.

U.S. Pat. No. 5,989,205 to Pond et al. discloses a solution applicator system having a retainer and a plurality of containers for holding a solution, such as fluoride or anesthetic, and an applicator member. Each container encloses the applicator and a solution-retaining receptacle with a puncturable sealing means. The '205 patent also does not address providing effective storage and application of a polymerizable monomer compound.

Monomer and polymer adhesives are used in both industrial (including household) and medical applications. Included among these adhesives are the 1,1-disubstituted ethylene monomers and polymers, such as the α-cyanoacrylates. Since the discovery of the adhesive properties of such monomers and polymers, they have found wide use due to the speed with which they cure, the strength of the resulting bond formed, and their relative ease of use. These characteristics have made the α-cyanoacrylate adhesives the primary choice for numerous applications such as bonding plastics, rubbers, glass, metals, wood, and, more recently, biological tissues.

It is known that monomeric forms of α-cyanoacrylates are extremely reactive, polymerizing rapidly in the presence of even minute amounts of an initiator, including moisture present in the air or on moist surfaces such as animal (including human) tissue. Monomers of α-cyanoacrylates are anionically polymerizable or free radical polymerizable, or polymerizable by zwitterions or ion pairs to form polymers. Once polymerization has been initiated, the cure rate can be very rapid.

Medical applications of 1,1-disubstituted ethylene adhesive compositions include use as an alternate or an adjunct to surgical sutures and staples in wound closure as well as for covering and protecting tissue wounds such as lacerations, abrasions, burns, stomatitis, sores, and other open surface wounds. When such an adhesive is applied, it is usually applied in its monomeric form, and the resultant polymerization gives rise to the desired adhesive bond.

However, due to the need to apply the adhesive in its monomeric form, and due to the rapid polymerization rate of the monomers, it has been very difficult to design effective and commercially viable packaging systems. Such packaging systems must counterbalance the competing requirements that the monomer not prematurely polymerize, that the monomer be easily applied, that the monomer polymerize at a desired rate upon application, and that the sanitary and/or sterile properties of the monomer and applicator—whether real or perceived—be maintained. This latter requirement, that the actual or perceived sanitary and sterile condition of the monomer and applicator be maintained, is particularly important in medical applications, where the user and/or the patient desires a clean product so as not to introduce further bacteria or foreign matter into a wound site.

In order to meet the above requirements, various packaging systems for monomeric adhesives have been proposed. These systems include large bottles with a single applicator, such as a large single- or multi-use brush; small applicators such as small ampoules containing monomer, for example within an internal frangible vial, that can be expelled through an integral applicator; and the like. However, a problem with many of these applicator systems is that the product contains more adhesive material than is necessary for a particular use. Because of the rapid polymerization rate of the monomers, any unused adhesive must often be discarded, because the remaining monomer undergoes polymerization, often within the applicator, to render the applicator unusable.

A further problem in addressing the above requirements of adhesive applicators and packaging is the need to provide a stable monomer product. Particularly in small quantities, such as single-dose sizes, cyanoacrylate monomers are prone to premature polymerization, which would render the product useless. Thus, industrial production of monomeric adhesive compositions has had to balance rapid cure rates and high bond strengths with shelf-life. The shelf-life of these adhesives is primarily related to stability (i.e., constancy of compositional nature), uncured physical properties, rate of cure of the adhesive, as well as final cured properties of the composition. For example, the shelf-life of a monomeric α-cyanoacrylate composition may be measured as a function of the amount of time the composition can be stored before unacceptable levels of polymerization, such as measured by viscosity increase, occur. Unacceptable levels are indicated by a level of polymerization product that reduces the usefulness of the composition in the application for which it is produced.

One proposed solution to this reduced shelf-life problem is to incorporate one or more stabilizers into the adhesive composition. For example, as disclosed in U.S. Pat. Nos. 3,559,652 to Banitt et al. and 5,582,834 to Leung et al., suitable stabilizers for medically useful α-cyanoacrylate compositions include Lewis acids such as sulfur dioxide, nitric oxide, and boron trifluoride, as well as free-radical stabilizers including hydroquinone, monomethyl ether hydroquinone, nitrohydroquinone, catechol, and monoethyl ether hydroquinone. The combination of the two anionic stabilizers sulfur dioxide and sulfonic acid is also known and is disclosed in, for example, British Patent Application GB 2 107 328 A.

However, while the proposed solution of adding stabilizers provides compositions that are more stable, a different problem arises. That new problem is that as the concentration of the added stabilizers increases in the composition, the cure rate of the composition tends to decrease. Thus, further components must be provided, such as in a separate composition, to be mixed with the adhesive composition (either directly or at the application site) to increase the polymerization rate of the monomer. Such additional materials, such as polymerization initiators or rate modifiers, increase the cost of the final composition, and may increase the complexity of use of the composition.

Known devices fail to provide a disposable package assembly that is optimized for convenient dispensing and application of adhesive materials on a variety of surfaces and structures. The known applicators are generally either optimized for delivery of other compositions or are inconvenient for use in conjunction with adhesives. Furthermore, such conventional devices and packaging generally do not address the competing needs of ease of use and adhesive stability prior to application.

SUMMARY OF THE INVENTION

The present invention addresses the above needs by providing applicators and dispensers that permit economical and efficient use of adhesive compositions. In embodiments of the present invention, applicator assemblies and dispensers are provided whereby single-use applicators/dispensers are provided with single-use amounts of adhesive material, thereby avoiding waste of excess adhesive material. The applicators and dispensers can be provided in multiple different sizes, to account for situations where more or less adhesive material may be required.

In embodiments, an applicator and an adhesive composition are packaged in a material that provides acceptable stability and shelf-life to the adhesive composition without the need to add separate stabilizer materials to the polymerizable monomer. Thus, in these embodiments, because the shelf-life is provided by the packaging material itself, the cure rate of the adhesive composition is not adversely affected, as in the case where one or more stabilizers are added. Accordingly, the need to apply separate polymerization initiators or rate modifiers can be reduced or even eliminated.

In other embodiments, the applicator assemblies include a polymerization initiator or accelerator for the adhesive material. The polymerization initiator or accelerator may be disposed in or on a tip or other part of the applicator. The tip or other portion of the applicator may be at least one of porous, absorbent and adsorbent in nature and the polymerization initiator or accelerator may be absorbed or adsorbed into the portion of the applicator. The applicator assemblies may also include a frangible barrier separating first and second compartments, for example, to keep the polymerization initiator or accelerator separated from the adhesive material prior to use.

In further embodiments, the applicator assemblies include first and second compartments that are open to each other with the polymerizable monomeric adhesive material contained in the first compartment and the applicator at least partially disposed in the second compartment. The applicator assemblies may further comprise a plunger that defines the second compartment and that is movable into the first compartment to displace the adhesive material into the second compartment. Thus, small volumes of adhesive material may be easily dispensed.

In particular, the present invention is directed to an applicator assembly for dispensing and applying a polymerizable monomeric adhesive material, comprising: a base portion having at least one sealed compartment; a polymerizable monomeric adhesive material contained in the at least one compartment; and an applicator at least partially disposed in the at least one compartment such that a tip of the applicator is proximate the polymerizable monomeric adhesive material; wherein removal of at least one of the applicator and the adhesive material requires the applicator assembly to be destructively unsealed.

In embodiments, the at least one sealed compartment may comprise a first sealed compartment and a second sealed compartment. The first and second compartments may be separated, with the polymerizable monomeric adhesive material contained in the first compartment and the applicator at least partially disposed in the second compartment. In embodiments, a frangible barrier separates the first and second compartments. In other embodiments, a substantially nonfrangible barrier separates the first and second compartments. In still other embodiments, the first and second compartments are open to each other.

In embodiments, a dispenser for a polymerizable monomeric adhesive material is made of a material that provides acceptable stability and shelf-life to the adhesive composition without the need to add separate stabilizer materials to the polymerizable monomer. As noted above, because the shelf-life is provided by the material of the dispenser, the cure rate of the adhesive composition is not adversely affected. Thus, the need to apply separate polymerization initiators or rate modifiers can be reduced or even eliminated.

In other embodiments, the dispensers include a polymerization initiator or accelerator for the adhesive material. The polymerization initiator or accelerator may be disposed in a separate reservoir of the dispenser that is preferably sealed from the adhesive material and/or the atmosphere. The seal for the initiator or accelerator and/or the adhesive material may comprise a frangible barrier, a cap, a deformable portion, a friction fit between parts or the like.

In particular, the present invention is directed to a dispenser for a polymerizable monomeric adhesive material, the dispenser including a first dispenser element defining a first reservoir, the first dispenser element having an open end and a closed end; a second dispenser element defining a chamber, the second dispenser element having an open end, a closed end and at least one aperture disposed between the open end and the closed end, the at least one aperture opening into the chamber; and a polymerizable monomeric adhesive material contained in the first reservoir, wherein at least the closed end of the second dispenser element is received in a first position by the first dispenser element to seal the adhesive material in the first reservoir.

In embodiments, a first circumferential ridge portion is situated between the closed end of the first dispenser element and the at least one aperture of the second dispenser element when the closed end of the second dispenser element is in the first position. The first circumferential ridge portion may be disposed on an inner surface of the first dispenser element or on an outer surface of the second dispenser element. The dispenser may also include a second circumferential ridge portion situated between the open end of the first dispenser element and the at least one aperture of the second dispenser element when the closed end of the second dispenser element is in the first portion. In embodiments, the first and second circumferential ridge portions form a continuous circumferential ridge.

In embodiments, the chamber and the at least one aperture comprise a second reservoir. A second material, such as a polymerization initiator or accelerator for the adhesive material, may be contained in the second reservoir. In other embodiments, the adhesive material may be contained in the second reservoir with the second material contained in the first reservoir.

In other embodiments, the present invention is directed to a dispenser for a polymerizable monomeric adhesive material, the dispenser comprising: a dispenser element defining a first reservoir, the dispenser element having an open end and a closed end; a circumferential ridge portion disposed on an inner surface of the dispenser element between the open end and the closed end; a stopper element sealingly fitted against the circumferential ridge portion to seal the first reservoir and define a chamber between the stopper element and the open end; and a polymerizable monomeric adhesive material contained in the first reservoir.

In embodiments, the circumferential ridge portion is deformable to release the stopper element. In other embodiments, the chamber comprises a second reservoir that may contain a second material. Alternatively, the second material may be contained in the first reservoir with the polymerizable monomeric adhesive material being contained in the second reservoir.

The present invention is also directed to kits, including one or preferably more of the applicator assemblies or dispensers. The applicator assemblies or dispensers can be provided with different amounts of adhesive, and/or different size applicators, and/or different amounts of polymerization initiator or accelerator.

BRIEF DESCRIPTION OF THE DRAWINGS

Exemplary embodiments of the present invention are described in detail below, with reference to the attached drawing figures, in which.

DETAILED DESCRIPTION OF EXEMPLARY EMBODIMENTS

In embodiments of the present invention, an applicator assembly, dispenser, packaging system or kit is provided that includes one or more applicators or dispensers packaged with a corresponding quantity of polymerizable adhesive material. The assembly or packaging is sealed to prevent external contaminants from entering, at least in the area where the adhesive material is contained.

Figure 1:
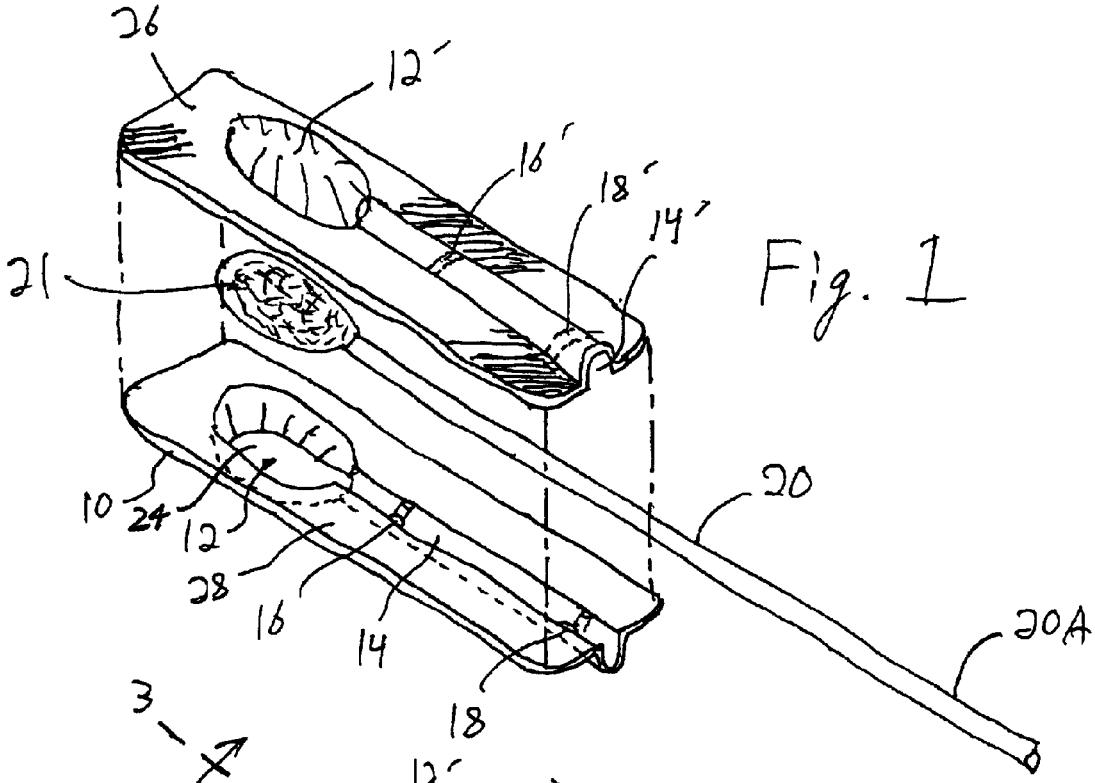
FIG. 1 is an exploded perspective view of a first embodiment of the present invention.
Figure 2:
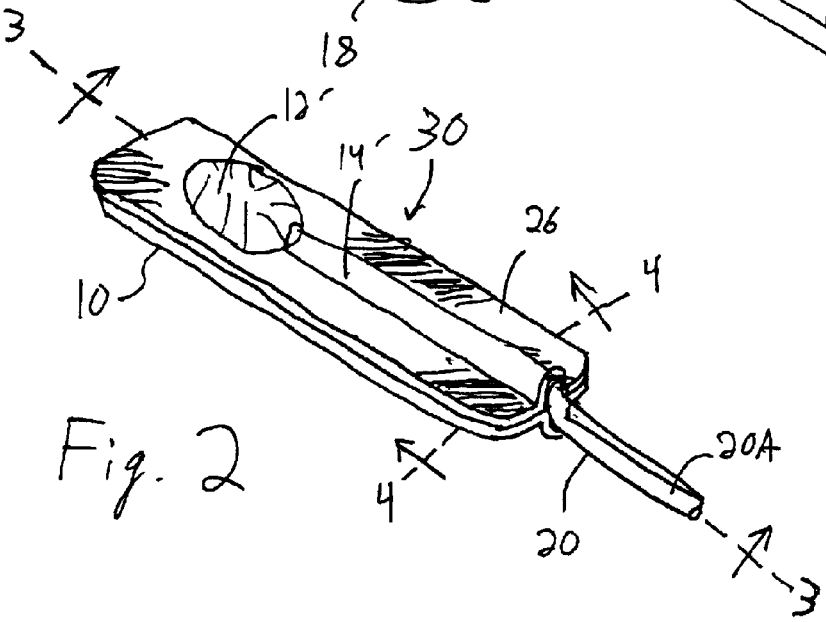
FIG. 2 is an assembled perspective view of the embodiment of FIG. 1.
Figure 3:
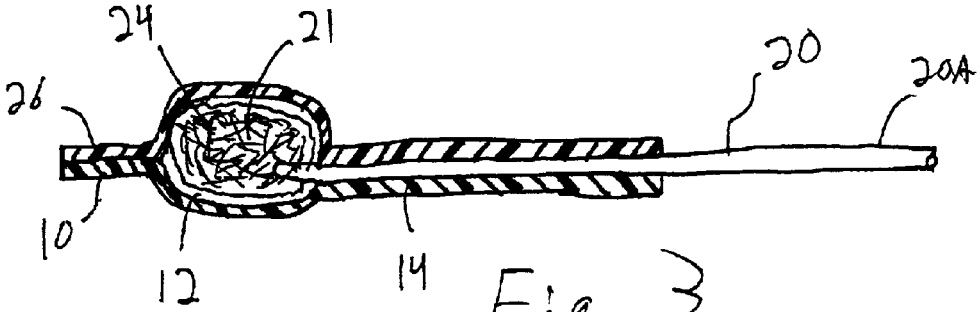
FIG. 3 is a cross section taken along line 3—3 in FIG. 2.

FIGS. 1–3 illustrates a first embodiment of the present invention, although the present invention is in no way limited to the specific design depicted therein. As shown in FIGS. 1–3, a tray 10 has formed therein a well 12 and an applicator passageway 14. The applicator passageway 14 is adapted to receive a portion of an applicator. The tray 10 may be made from any suitable material, as will be described in greater detail below. Preferably, the material is easily vacuum formed in order to make the well 12 and the applicator passageway 14 therein. Alternatively, other known or later developed techniques may be employed, such as stamping, injection molding, shrink wrapping, etc.

Formed within the applicator passageway 14 may be one or may retainers, shown as retainer 16 and/or a seal 18. The retainer 16 and the seal 18 are, for example, protrusions that extend into the interior of the applicator passageway 14 a predetermined distance. The retainer 16 can also be a seal. The retainer 16 and the seal 18 may be partially or altogether replaced by particular technique employed to form the tray 10, such as shrink wrapping.

The applicator may be a fibrous swab, a sponge swab, a foam swab, a brush, a spatula or the like. In this first embodiment, the applicator is illustrated as a swab 20. The swab 20 has a handle portion 20A and a swab tip 21. The swab handle 20A is shown as having a substantially uniform lateral dimension, although it is not limited to such a design. The swab tip 21 of the applicator swab 20 fits within the well 12 with part of the handle portion 20A being in the passageway 14 and the major portion of the applicator handle 20A preferably, but not necessarily, extending beyond the tray 10.

The passageway 14 preferably has lateral dimensions matching the lateral dimensions of the handle portion 20A, except for the retainer 16 and the seal 18. The retainer 16 is positioned to contact the handle portion 20A. This helps to prevent the applicator swab 20 from being unintentionally removed from the applicator passageway 14. As shown, a substantial portion of the handle portion 20A extends beyond the open end or edge of the applicator passageway 14. However, in some applications only a portion of handle portion 20A sufficient to grasp easily, or none at all, may extend beyond the open end of the applicator passageway 14. The seal 18 at the end of applicator passageway 14 helps to prevent contamination from entering the open end of applicator passageway 14.

A polymerizable adhesive composition 24 is located within the well 12, either as a separate component or as partially or completely absorbed or adsorbed on or into applicator swab 21. The amount of polymerizable adhesive composition 24 placed within the well 12 is sufficient to perform a specific procedure for a single patient. In other words, an amount suitable for a single use is located within the well 12.

A cover 26 is affixed to a top planar surface 28 of tray 10. The cover 26 also includes a corresponding recess 12' and an applicator passageway 14' therein. The applicator passageway 14' may also include one or more retainers or seals, shown as a retainer 16' and a seal 18'. The cover is preferably made of the same material as the tray 10, and in embodiments can be functionally equivalent to the tray 10. The cover 26 can be affixed to the tray 10 in any suitable manner, for example, with an adhesive, ultrasonic welding, solvent welding, heat sealing and the like. The cover 26 seals the polymerizable adhesive composition 24 and at least the swab tip 21 of the applicator within the tray 10 and also helps to hold the handle portion 20A within the applicator passageway 14.

In an alternative embodiment (not shown), the cover 26 need not have corresponding recess 12' and/or applicator passageway 14'. Instead, the cover 26 can be either flat, or substantially flat. However, a cover 26 having the corresponding recess 12' and applicator passageway 14' is preferred in embodiments because this design minimizes excess open volume around the applicator, and more readily permits the entire package to be opened with either the tray 10 or the cover 26 in the upward-facing direction. Likewise, if desired, the cover 26 can be formed such that it partially matches the recess 12' and/or applicator passageway 14' of the tray 10, without having exact or substantial correspondence with the recess 12 and/or applicator passageway 14 of the tray 10. Other variations of the tray 10 and cover 26 will be readily apparent to one of ordinary skill in the art, and are within the scope of the present invention.

FIG. 2 illustrates the embodiment of FIG. 1 in assembled form. After assembly, a single-use applicator assembly 30 is formed. The cover 26 extends over the entire top surface of the tray 10. However, the cover 26 may extend over only part of the length of the tray 10 to facilitate opening of the assembly 30.

The handle portion 20A of the swab 20 extends beyond the open end or edge of the applicator passageway 14, yet is securely held therein. The extension of applicator handle 20A beyond the tray 10 substantially reduces the amount of material normally required in a disposable, single-use-type package including an applicator device. The handle portion 20A may also act as a handle for grasping the overall assembly 30. The extension of the swab 20 beyond the applicator passageway 14 also helps in removing the cover 26, which is often securely attached to the top surface of the tray 10. The handle portion 20A may be used to pry the cover 26 upward. This is helpful in opening the tray 10.

FIG. 3 illustrates, with respect to the first embodiment, a side cross-sectional view of the assembly 30. This figure shows the well 12 preferably forming a tight fit around the swab tip 21 with the polymerizable adhesive composition 24 therein. The handle portion 20A extends through the applicator passageway 14 and extends beyond the ends of the tray 10 and the cover 26.

Figure 4:
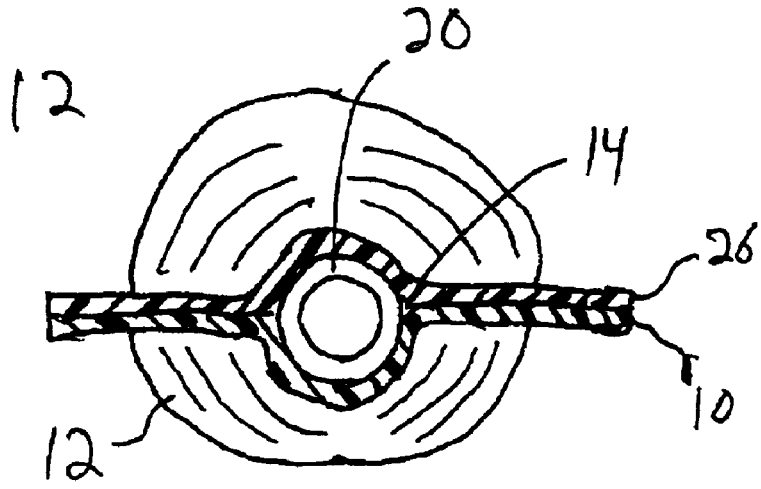
FIG. 4 is a cross section taken along line 4—4 in FIG. 2.

FIG. 4 more clearly illustrates the applicator passageway 14 formed within tray 10 according to the first embodiment. The applicator passageway 14 also preferably tightly fits around the handle portion 20A to secure the applicator swab 20 within the assembly 30. Sealing can be further enhanced by the retainer 16 and/or the seal 18 (shown in FIG. 1).

Figure 5:
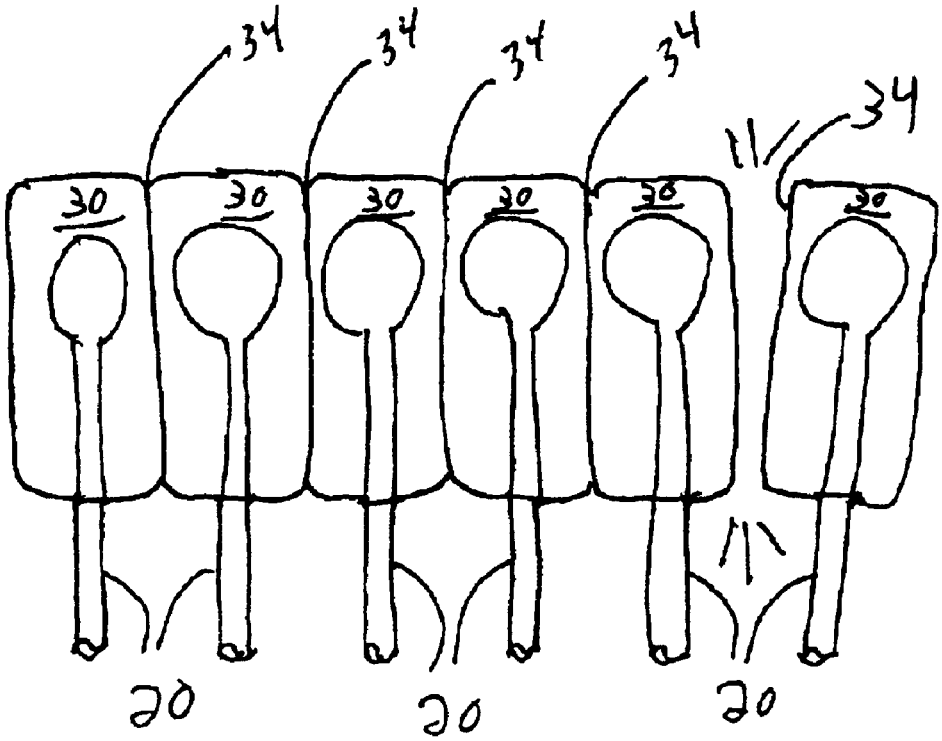
FIG. 5 illustrates a top view of a plurality of connected single packages of the embodiment of FIG. 1.

FIG. 5 illustrates the first embodiment in the form of a plurality of single-use applicator assemblies 30 formed as a continuous strip or a plurality of connected assemblies 30 that are frangibly connected together by a readily frangible connection 34. Each individual single-use applicator assembly 30 may be easily snapped or torn off at the frangible connection 34 for use. The feature of the present invention illustrated in FIG. 5 of providing a plurality of frangibly connected single patient dose or unit dose packages 30 is particularly applicable when a particular procedure may require a sequence of applications of polymerizable adhesive material. In such a case, the required number of applications and/or different materials for a given procedure are conveniently provided together in a more convenient packaging.

The packaging in which the applicator is packaged is preferably made of a material that tends to stabilize the adhesive monomer composition. Thus, it is possible and preferred in embodiments of the present invention that the adhesive composition does not include, or is substantially free of, one or more stabilizer components such as are known and used in the art as additives to the adhesive monomer composition. This may reduce, or even eliminate, the need for a polymerization initiator or accelerator.

For example, suitable materials include halogenated packaging materials, preferably fluorinated packaging materials. For example, where the packaging material is formed from a plastic or similar material, it is preferred that the material, or at least a surface portion thereof that will be in contact with the adhesive monomer composition, is formed from a halogenated plastic material or is coated by a halogenated material. The ability of such halogenated polymers to provide barrier properties, and contribute to stability of adhesive compositions, is described in further detail in copending U.S. application Ser. No. 09/430,289, filed Oct. 29, 1999, the entire disclosure of which is incorporated herein by reference. Likewise, in embodiments, the packaging materials can include functionalized polymeric materials, such as are disclosed in the '289 application, where the functionalization provides the desired stabilizing effect to the adhesive composition. Of course, in embodiments, it may be desirable and/or necessary to add a separate stabilizer component to the adhesive composition, either to completely stabilize or fine-tune the stabilization characteristics of the adhesive composition.

Where polymer materials are used to form the packaging, the packaging may comprise a halogenated, preferably fluorinated, polymer on at least the internal surface of the packaging, at least in the area in contact with the adhesive monomer composition. As used herein, a "halogenated polymer" can be any halogenated polymer that is known or becomes known in the art or can be any polymeric material that is suitable for fabrication of packaging that is subsequently or concurrently halogenated by at least one known halogenation method. However, the halogenation process must not render the polymeric material unusable as a packaging material. As used herein, a "fluorinated polymer" is thus a halogenated polymer, wherein the halogen comprises, in whole or in part, fluorine.

The packaging material preferably comprises any suitable halogenated polymeric material, including, but not limited to, polyolefins, halogenated hydrocarbons (halocarbons), and engineered resins. The packaging can comprise homopolymers, copolymers, higher order polymers, or mixtures thereof, and can comprise one species of polymeric material or mixtures of multiple species of polymeric material. As desired and/or necessary, the polymeric materials can be halogenated or otherwise functionalized either prior to manufacture of the packaging, during manufacture of the packaging, or subsequent to manufacture of the packaging. Pre-halogenated (or pre-functionalized) materials are generally those that are already halogenated or functionalized, such as where halogenated or functionalized monomers are used to form the polymer package product. Concurrently halogenated or functionalized materials are those where although the precursor materials may not themselves be halogenated or flunctionalized, the halogenation or functionalization is introduced during the manufacturing process. For example, where the package product is made by molding, the halogenation or functionalization can be introduced by using a reactive halogen-containing gas. Likewise, post-halogenated or postfunctionalized materials are those where the package product is first prepared, and then the formed polymeric material is subsequently halogenated or functionalized.

Packaging materials of the present invention can, for example, comprise polyolefin polymers. Suitable polyolefins include, but are not limited to, polyethylene (PE), such as high-density polyethylene (HDPE), medium-density polyethylene (MDPE); low-density polyethylene (LDPE), cross-linked high-density polyethylene (XLPE), linear low-density polyethylene (LLDPE), ultra low-density polyethylene, and very low-density polyethylene; polycarbonate (PC); polypropylene (PP); polypropylene copolymer (PPCO); polyallomer (PA); polymethylpentene (PMP or TPX); polyketone (PK); polyethylene terephthalates (PET), including polyethylene terephthalate G copolymer (PETG) and oriented PET; polystyrene (PS); polyvinylchloride (PVC); naphthalate; polybutylene terephthalate; thermoplastic elastomer (TPE); mixtures thereof; and the like. Exemplary densities of the above polyethylenes are as follows: LDPE—0.910–0.925 g/cm$^3$; medium-density polyethylene (MDPE)—0.926–0.940 g/cm$^3$; HDPE—0.941–0.965 g/cm$^3$. Other densities can be determined by the ordinary artisan by referencing, for example, ASTM D 1248 (1989).

The packaging of the present invention can comprise halogenated hydrocarbons (also referred to herein as halocarbons). For example, exemplary fluorinated hydrocarbons include, but are not limited to, Halar® ethylene-chlorotrifluoroethylene copolymer (ECTFE) (Allied Chemical Co., Morristown, N.J.); Tefzel® ethylene-tetrafluoroethylene (ETFE) (duPont, Wilmington, Del.); tetrafluoroethylene (TFE); polytetrafluoroethylene (PTFE); fluorinated ethylene propylene (FEP); polytetrafluoroethylene fluorinated ethylene propylene (PTFE-FEP); polyvinyl fluoride (PVF); polytetrafluoroethylene perfluoroalkoxy (PTFE-PFA); polyvinylidene fluoride (PVDF); mixtures thereof; and the like.

The packaging of the present invention can comprise engineered resins. Exemplary engineered resins include, but are not limited to, polyamide, such as nylon; polyphenylene oxides (PPO); polysulfone (PSF); mixtures thereof; and the like.

In embodiments, the packaging of the present invention can comprise mixtures of the above polyolefins, halogenated hydrocarbons, and/or engineered resins.

Preferably, in embodiments, the packaging material is suitable for vacuum molding and/or vacuum filling. That is, in order to provide a tight fit of the container around the applicator, and particularly around the applicator tip that contains the adhesive monomer composition and/or components thereof, it is preferred that the material is such that it can form to the shape of the applicator, so as to provide a tight, and preferably airtight, fit.

Preferably, the packaging, at least in an area surrounding the polymerizable monomeric adhesive material, is of a shape and design to minimize the ratio between the surface area of the package and the volume of polymerizable monomeric adhesive material and/or minimizing the head space within the well. By minimizing this ratio and/or the head space, stabilization of the adhesive composition is increased. For example, it is believed that stabilization can be decreased where air, moisture or other materials permeate through the packaging and into the adhesive composition. By minimizing the surface area of the adhesive-containing portion of the package, the effect of such permeation can be reduced. Although not limited thereto, this ratio can generally be minimized by forming the adhesive-containing portion of the package to be spherical, or substantially so (such as egg-shaped). Furthermore, this packaging design, at least in an area surrounding the polymerizable monomeric adhesive material, minimizes the permeation of the polymerizable monomeric adhesive material out of the packaging.

Although FIG. 1 shows the applicator as containing a swab, the present invention is not limited to such embodiments. In particular, any suitable applicator tip can be used according to the present invention. Such suitable applicator tips include swabs, brushes, spatulas, droppers, syringes, and the like. Any suitable applicator tip can be used that allows for application of the adhesive composition to the desired site, and thus different applicator tips may be appropriate for different application methods.

The applicator tip can have a variety of suitable shapes, including, but not limited to, conical, cylindrical, chisel or polygonal shapes such as rectangular or trapezoidal. The length and size of the tip can be varied depending on various application parameters. The tip may be detachable from the applicator body, or may be an integral part of the applicator.

The applicator tip can be composed of any of a variety of materials including polymerized materials such as plastics, foams, rubber, thermosets, films, or membranes. Additionally, the applicator tip may be composed of materials such as metal, glass, paper, ceramics, cardboard, and the like. The applicator tip material may be porous, absorbent, or adsorbent in nature to enhance and facilitate application of the adhesive composition. In general, the only limitation on the materials used to fabricate the tip is that the tip must be sufficiently compatible with the composition to be dispensed that undesirable effects on the composition do not prevail during contact of the composition with the tip. Thus, for example, according to embodiments of the present invention where the adhesive composition is packaged as already being absorbed or adsorbed into the applicator tip, or in direct contact with the applicator tip, the applicator tip is preferably made from a material that tends to stabilize, or at least does not prematurely polymerize, the adhesive monomer composition. Where the applicator tip is made from polymer materials, the polymer material can be the same as or different from those specified above for the packaging materials. Suitable designs for applicator tips that may be used according to the present invention are disclosed in, for example, U.S. patent application Ser. Nos. 08/488,411, filed Jun. 7, 1995, 09/069,979, filed Apr. 30, 1998, 09/069,875, filed Apr. 30, 1998, and 09/385,030, filed Aug. 30, 1999, the entire disclosures of which are incorporated herein by reference.

In embodiments of the present invention, it is preferred that all of the components that contact the polymerizable monomeric adhesive material include or are made from materials that stabilize the monomer, as discussed above. Thus, the packaging, at least in the area around the polymerizable monomeric adhesive material, and the applicator tip (when the polymerizable monomeric adhesive material is pre-absorbed or adsorbed in the applicator tip), and optionally the applicator itself, preferably include such materials.

Furthermore, the applicator tips of the applicators of the present invention can be provided in any of various sizes, depending on the desired use of the product. For example, a standard preferred swab size can be a rectangular shape having a size of about 1.3 cm×1.0 cm×0.64 cm. However, larger or smaller sizes can be used, where the sizes are tailored to the shape of the tip and/or the amount of adhesive material to be applied for a given application. Thus, for example, where the applicator is intended for applications requiring a large amount of adhesive material, a larger (and/or more absorbent) applicator tip can be used; whereas where the applicator is intended for applications requiring only a small amount of adhesive material, a smaller (and/or less absorbent) applicator tip can be used. Tailoring the size or absorbency/adsorbency of the applicator tip to the amount of adhesive required can help prevent waste of adhesive material. For example, where a large tip (and large amount of adhesive) is used for a small adhesive application, the remaining adhesive in the tip is generally wasted due to premature polymerization of the adhesive in the applicator tip.

Furthermore, although FIG. 5 shows a plurality of connected single assemblies of generally all the same size, the present invention is not limited to such an embodiment. Rather, as shown in FIGS. 1 and 5, the applicators of the present invention can be in the form of either single assemblies, multiple connected assemblies or multiple unconnected assemblies retained together in an enclosure. Furthermore, where multiple assemblies are used, either in a connected form or separate, the multiple assemblies can be of different sizes. Thus, for example, multiple applicator assemblies can be provided where each of the applicators contains the same amount of adhesive composition, or where different amounts of adhesive composition are provided.

Figure 6:
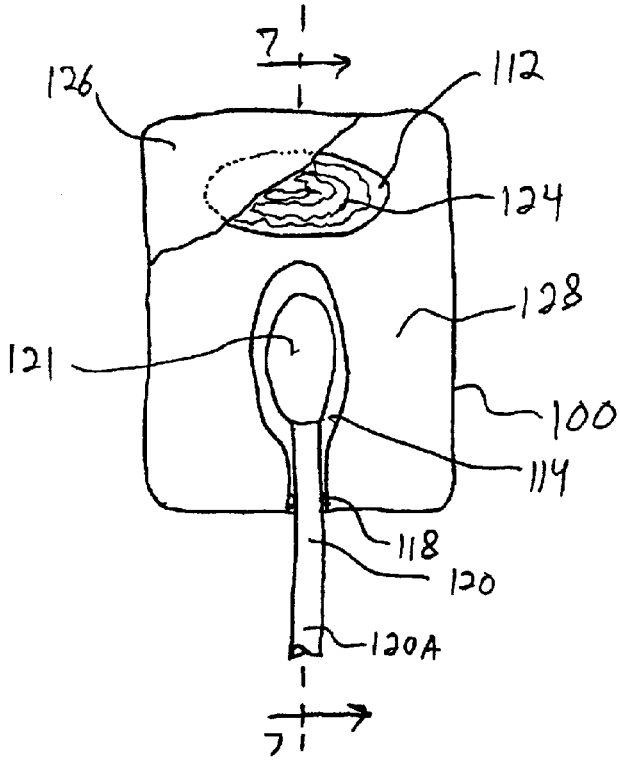
FIG. 6 is a perspective view of a second embodiment of the present invention.
Figure 7:
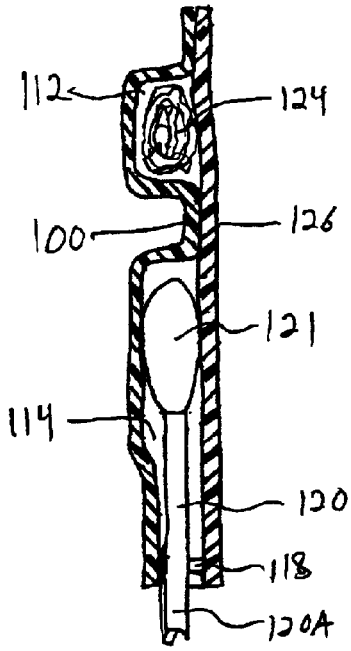
FIG. 7 is a cross section taken along line 7—7 in FIG. 6.

In a second embodiment of the present invention, such as shown in FIGS. 6 and 7, the applicator assembly can be provided wherein the polymerizable adhesive composition is maintained separate from the applicator tip. As shown in FIG. 6, a tray 100 has formed therein a well 112 and an applicator passageway 114. The tray 110 may be made from any suitable material, such as those described above. As described above, the applicator passageway 114 may have one or may retainers therein, shown as a seal 118. Again, the applicator itself may be a fibrous swab, a sponge swab, a foam swab, a brush, a spatula or the like, as described above. In this second embodiment, the applicator is illustrated as a swab 120 with a handle portion 120A and a swab tip 121, the swab tip 121 fitting within the passageway 114 with the major portion of the applicator handle 120A extending beyond the tray 110. As described above, the cover 126 can be planar, can have partially corresponding wells and passageways or other surface features, or can have corresponding wells and passageways to the wells and passageways of the tray 110. FIG. 7 shows the embodiment where the cover 126 is planar. Other variations of the tray 10 and cover 26 will be readily apparent to one of ordinary skill in the art, and are within the scope of the present invention.

Similar to the first embodiment, a polymerizable adhesive composition 124 is located within the well 112. Also, a cover 126 is affixed in any suitable manner, for example, with an adhesive, ultrasonic welding, solvent welding, heat sealing and the like, to a top planar surface 128 of the tray 110.

FIG. 7 illustrates, in this second embodiment, a side cross-sectional view of the assembly. This figure shows the well 112, containing the polymerizable adhesive material 124, and the well/passageway 114, holding the applicator swab 120.

A third exemplary embodiment of a single-use applicator assembly 200 according to the present invention is shown in FIGS. 8–13. A base portion 210 of the applicator assembly 200 has at least one compartment 212. A frangible barrier 222 divides the at least one compartment 212 into a first compartment 214 that contains an amount of a polymerizable adhesive material 220 and a second compartment 216 in which an applicator 230 is at least partially disposed. Both the first and second compartments 214, 216 are preferably sealed. As shown, a seal 218 is disposed at an open end of the second compartment 216. As with the previously described embodiments, the applicator 230 may be any suitable applicator, such as that shown with a swab tip 232 and a swab handle 234.

Figure 8:
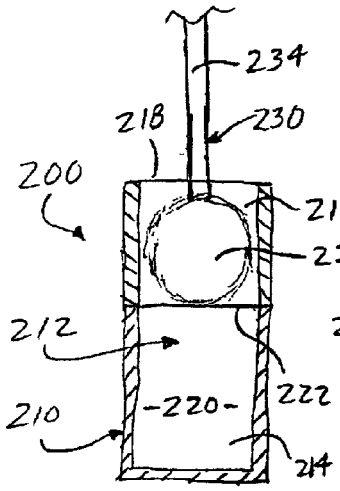
FIGS. 8–10 are cross-sectional views of a third embodiment of the present invention illustrating stages of use.
Figure 9:
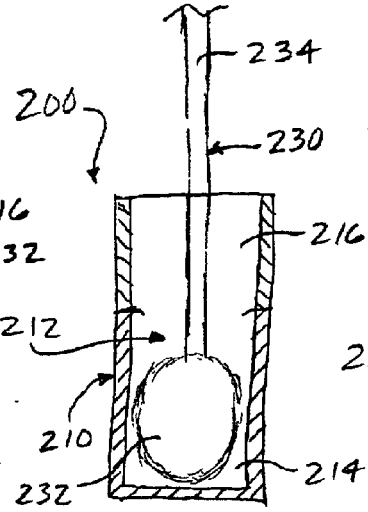
Figure 10:
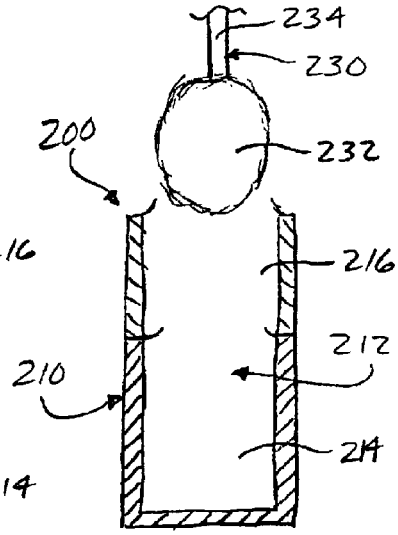
Figure 11:
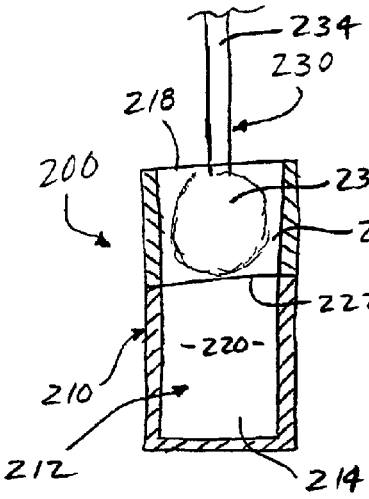
FIGS. 11–13 are cross-sectional views of the embodiment of FIGS. 8–10 illustrating alternate stages of use.
Figure 12:
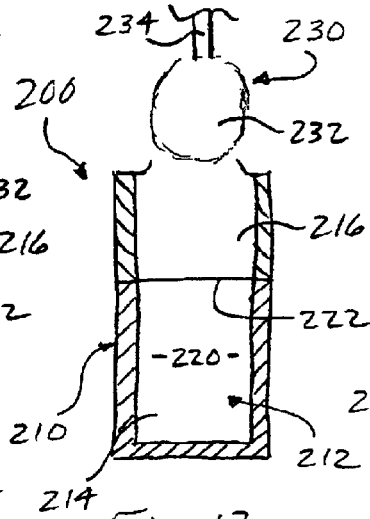
Figure 13:
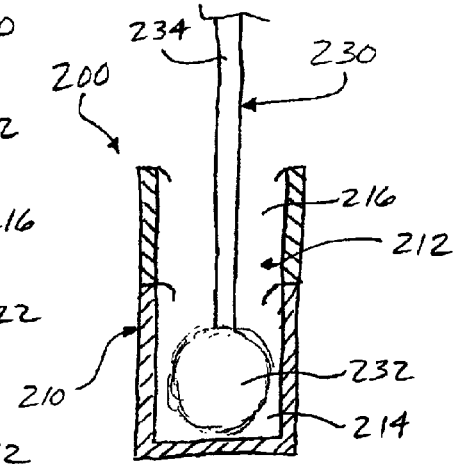

A first method of use of the applicator assembly is illustrated in FIGS. 8–10. FIG. 8 illustrates the applicator assembly 200 prior to use. Using the swab handle 234, the applicator 230 is moved toward the first compartment 214 such that the swab tip 232 penetrates the frangible barrier 222. The swab tip 232 absorbs, adsorbs or otherwise takes on the amount of the polymerizable adhesive material 220 by entering the first compartment 214, as shown in FIG. 9. The swab tip 232 is then removed from the overall compartment 212 using the swab handle 234 so that the polymerizable adhesive material 220 can be applied to a desired surface.

At least the base portion 210 and the frangible barrier 222 are preferably made of a material that promotes the stability of the polymerizable adhesive material 220. Furthermore, the entire applicator assembly 200 may be made of such a material. Suitable materials include the materials described in detail above. The second compartment 216 may contain an initiator or rate modifier to promote polymerization and/or cross-linking of the polymerizable adhesive material 220 in use. In particular, the initiator or rate modifier may be incorporated into the swab tip 232.

Additionally or alternatively, the second compartment 216 may contain a medicament, an anesthetic and/or other material to be applied. In such a case, the method of use illustrated in FIGS. 11–13 may be employed. For example, the swab tip 232 carrying the medicament, anesthetic and/or other material is removed from the second compartment 216 by breaking the seal 218. The medicament, anesthetic or other material is then applied to the desired surface.

Thereafter, the swab tip 232 is reinserted into the base portion 210 to penetrate the frangible barrier 216 and enter the first compartment 214. The polymerizable adhesive material 220 is absorbed, adsorbed or otherwise taken on by the swab tip 232 which is then removed from the base portion 210 to apply the polymerizable adhesive material 220 to the desired surface.

The method of use illustrated in FIGS. 8–10 may be used for simultaneous application of the polymerizable adhesive material 220 and another material that is contained in either of the first and second compartments 214 and 216.

Thus, for example, where an amount of adhesive material is contained in the first compartment 214 and another materials is contained in the second compartment 216, both materials can be applied at the same time. In this embodiment, rather than drawing the applicator out of the second compartment 216 through the seal 218, the applicator is first pushed through the barrier 222 to enter the first compartment 214. The respective materials in compartments 214 and 216 can thus be mixed, either by their simple intermingling or by a mixing action exerted on the applicator, and the combined materials may be absorbed, adsorbed, or otherwise taken up by the applicator. The applicator can then be drawn back through the broken barrier 222, and through the seal 218. The combination of materials is then applied to the desired surface.

As illustrated by these methods of use, the applicator assembly 200 allows easy application of the polymerizable adhesive material 220, and a second material as desired, that may be accomplished with one hand. The applicator assembly 200 maintains the materials in a sealed condition prior to use and preferably leaves no excess adhesive material 220 or other material since the applicator assembly 200 is designed for a single use.

Figure 17:
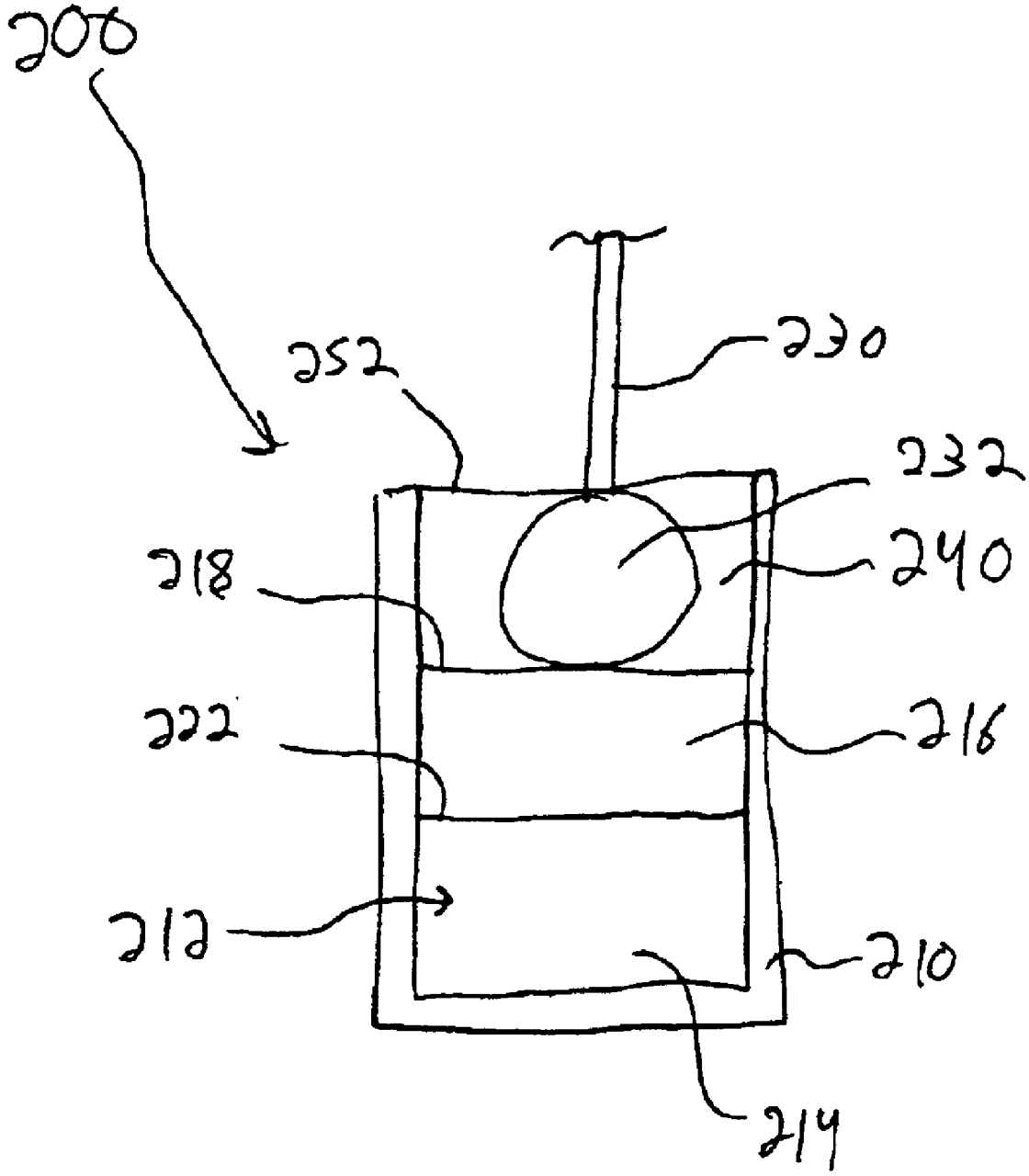
FIG. 17 is a cross-sectional view of a modification of the third embodiment.

A modification of the applicator of this embodiment is shown in FIG. 17. Although the applicator is described above as having an internal area 212 that is divided into two compartments 214,216, the applicator is not limited to such a design. Rather, if desired, the internal area 212 can be divided into any number of compartments, to provide any desired methods of applying one or more materials. For example, as shown in FIG. 17, the internal area 212 can be divided into three compartments 214, 216, 240. Each of the compartments can have the same or different materials, as described above, and can be applied either consecutively or together, as also described above.

Furthermore, although the above description is with respect to there being a seal 218 at the end of the container, such a seal is not required. For example, where the applicator tip does not itself contain a separate application component, and/or where the uppermost compartment (216 in FIGS. 8–13, 240 in FIG. 17) does not contain a separate application component, a separate seal need not be provided. Thus, for example, the container and the applicator can be packaged separately, rather than as a single unitary device. Likewise, a kit can be provided having one or more applicators, such as of different sizes or shapes, or constructions, and one or more containers containing the material(s) to be applied.

Figure 14:
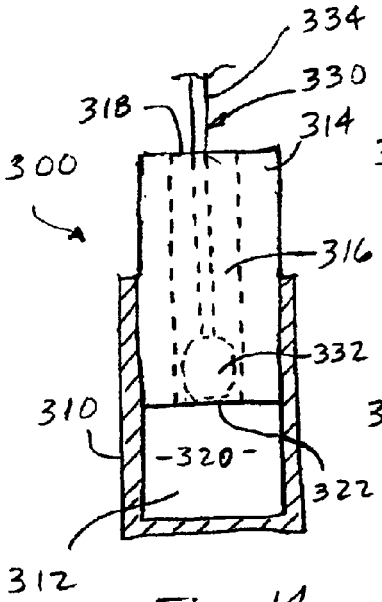
FIGS. 14–16 are cross-sectional views of a fourth embodiment of the present invention illustrating stages of use.
Figure 15:
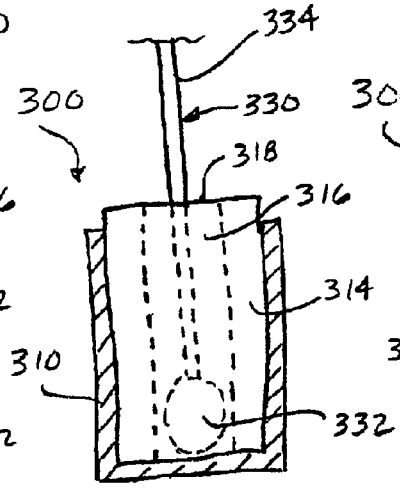
Figure 16:
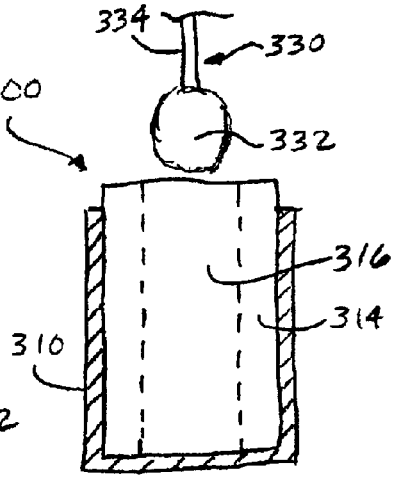

A fourth exemplary embodiment of a single-use applicator assembly 300 according to the present invention is shown in FIGS. 14–16. A base portion 310 of the applicator assembly 300 has a first compartment 312. A plunger 314 is situated partially within the base portion 310 such that the plunger 314 is movable therein. The plunger 314 defines a second compartment 316 that is either open to the first compartment 312 or separated from the first compartment 312 by a frangible barrier 322. The first compartment 312 contains an amount of a polymerizable adhesive material 320 and the second compartment 316 has an applicator 330 at least partially disposed therein. Both the first and second compartments 312, 316 are preferably sealed. As shown, a seal 318 is disposed at an open end of the second compartment 316, which extends through the plunger 314. As with the previously described embodiments, the applicator 330 may be any suitable applicator, such as that shown with a swab tip 332 and a swab handle 334.

FIG. 14 illustrates the applicator assembly 300 prior to use. In use, as shown in FIG. 15, the plunger 314 is moved into the first compartment 312 to displace the amount of the polymerizable adhesive material 320 into the second compartment 316. If the frangible barrier 322 is present, the pressure generated from the movement of the plunger 314 into the first compartment 312 will rupture the frangible barrier 322.

The swab tip 332 absorbs, adsorbs or otherwise takes on the amount of the polymerizable adhesive material 320 as it enters the second compartment 316. The swab tip 332 is then removed from the plunger 314 using the swab handle 334 so that the polymerizable adhesive material 320 can be applied to a desired surface. In this embodiment, the plunger 314 allows very small, in the microliter range, amounts of the polymerizable adhesive material 320 to be efficiently dispensed.

At least the base portion 310, the plunger 314 and the frangible barrier 322 (when included) are preferably made of a material that promotes the stability of the polymerizable adhesive material 320. Furthermore, the entire applicator assembly 300 may be made of such a material. Suitable materials include those described above. In particular, a combination of relatively pure resins, such as Allethon 6017 for the base portion 310 and Marlex 5250 for the plunger 314, is highly desirable for stability of the polymerizable adhesive material 320.

As with the third embodiment, the second compartment 316 of the fourth embodiment may contain an initiator or rate modifier to promote polymerization and/or cross-linking of the polymerizable adhesive material 320 in use. In particular, the initiator or rate modifier may be incorporated into the swab tip 332. Additionally or alternatively, the second compartment 316 may contain a medicament, an anesthetic and/or other material to be applied.

In such a case, the applicator assembly 300 may be used similarly to the two methods of use described above for the third embodiment, except that the plunger 314 is employed, so that the medicament, anesthetic and/or other material may be applied before or concurrently with the polymerizable adhesive material 320.

A fifth exemplary embodiment of a single-use applicator assembly 400 according to the present invention is shown in FIGS. 18–23. A base portion 410 of the applicator assembly 400 has at least one compartment 412. A plunger 440 divides the at least one compartment 412 into a first compartment 414 that contains an amount of a polymerizable adhesive material 420 and a second compartment 416 in which an applicator 430 is at least partially disposed. The plunger 440 contacts the base portion 410 at least at a portion 442 of the plunger 440. Further, at least one channel 444 is formed on an outer wall of the plunger 440.

Both the first and second compartments 414, 416 are preferably sealed. As shown, a seal 418 is disposed at an open end of the second compartment 416. The portion 442 of the plunger 440 seals against the base portion 410 by a friction fit when in the position shown in FIG. 18. While a good friction fit may be achieved by using dissimilar plastics for the base portion 410 and the portion 442 of the plunger 440, one may also use similar plastics because of compatibility considerations for the polymerizable adhesive material 420.

As with the previously described embodiments, the applicator 430 may be any suitable applicator, such as that shown with a swab tip 432 and a swab handle 434.

Figure 18:
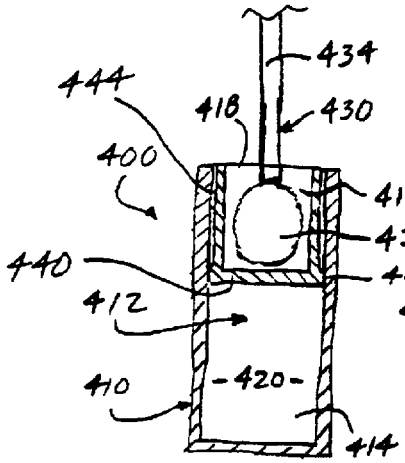
FIGS. 18–20 are cross-sectional views of a fifth embodiment of the present invention illustrating stages of use.
Figure 19:
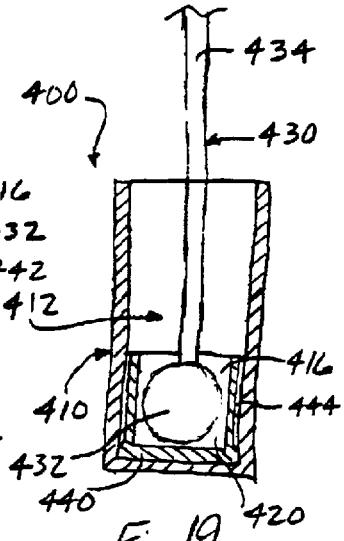
Figure 20:
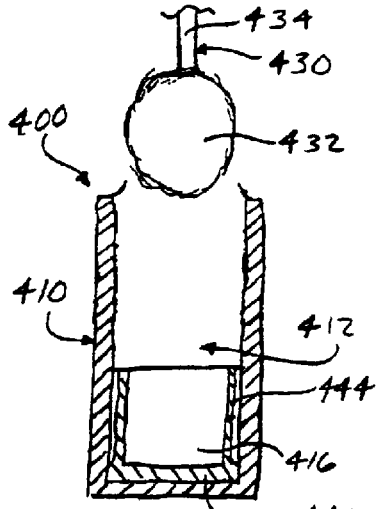
Figure 21:
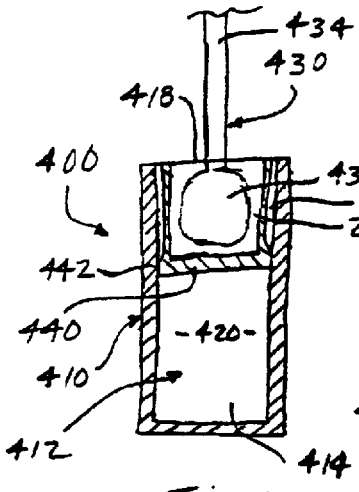
FIGS. 21–23 are cross-sectional views of the embodiment of FIGS. 18–20 illustrating alternate stages of use.
Figure 22:
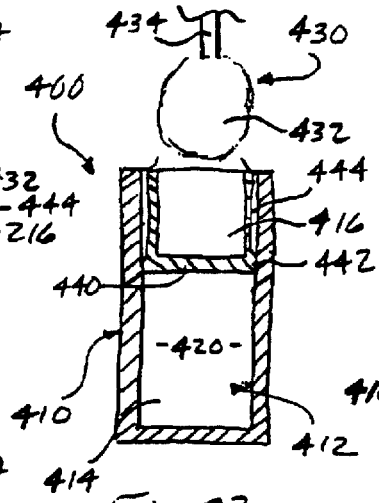
Figure 23:
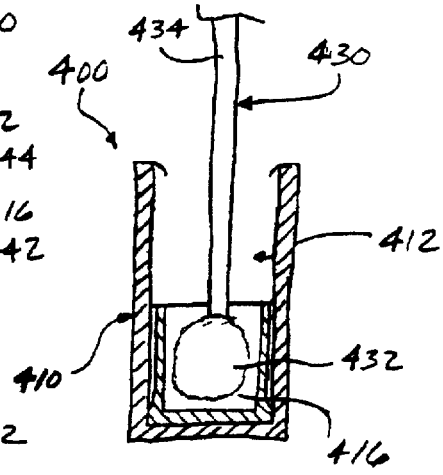

A first method of use of the applicator assembly is illustrated in FIGS. 18–20. FIG. 18 illustrates the applicator assembly 400 prior to use. Using the swab handle 434, the applicator 430 is pushed against the plunger 440 to move the plunger 440 toward the first compartment 414 such that the polymerizable adhesive material 420 is forced past the portion 442 and into the second compartment 416 through the channel(s) 444. The swab tip 432 absorbs, adsorbs or otherwise takes on the amount of the polymerizable adhesive material 420 entering the second compartment 416, as shown in FIG. 19. The swab tip 432 is then removed from the overall compartment 412 using the swab handle 434 so that the polymerizable adhesive material 420 can be applied to a desired surface.

At least the base portion 410 and the portion 442 of the plunger 440 are preferably made of a material that promotes the stability of the polymerizable adhesive material 420. Furthermore, the entire applicator assembly 400 may be made of such a material. Suitable materials include the materials described in detail above. The second compartment 416 may contain an initiator or rate modifier to promote polymerization and/or cross-linking of the polymerizable adhesive material 420 in use. In particular, the initiator or rate modifier may be incorporated into the swab tip 432.

Additionally or alternatively, the second compartment 416 may contain a medicament, an anesthetic and/or other material to be applied. In such a case, the method of use illustrated in FIGS. 21–23 may be employed. For example, the swab tip 432 carrying the medicament, anesthetic and/or other material is removed from the second compartment 416 by breaking the seal 418. The medicament, anesthetic and/or other material is then applied to the desired surface.

Thereafter, the swab tip 432 is reinserted into the base portion 410 and pushed against the plunger 440 to move the plunger 440 toward the first compartment 414 such that the polymerizable adhesive material 420 is forced past the portion 442 and into the second compartment 416 through the channel(s) 444. The polymerizable adhesive material 420 is absorbed, adsorbed or otherwise taken on by the swab tip 432 which is then removed from the base portion 410 to apply the polymerizable adhesive material 420 to the desired surface.

The method of use illustrated in FIGS. 18–20 may be used for simultaneous application of the polymerizable adhesive material 420 and another material that is contained in either of the first and second compartments 414 and 416.

Thus, for example, where an amount of adhesive material is contained in the first compartment 414 and another materials is contained in the second compartment 416, both materials can be applied at the same time. In this embodiment, rather than drawing the applicator out of the second compartment 416 through the seal 418, the applicator first pushes the plunger 442 to enter the first compartment 414. The respective materials in compartments 414 and 416 can thus be mixed, either by their simple intermingling or by a mixing action exerted on the applicator, and the combined materials may be absorbed, adsorbed, or otherwise taken up by the applicator. The applicator can then be drawn out of the plunger 440 and through the seal 418. The combination of materials is then applied to the desired surface.

As illustrated by these methods of use, the applicator assembly 400 allows easy application of the polymerizable adhesive material 420, and a second material as desired, that may be accomplished with one hand. The applicator assembly 400 maintains the materials in a sealed condition prior to use and preferably leaves no excess adhesive material 420 or other material since the applicator assembly 400 is designed for a single use.

Furthermore, although the above description is with respect to there being a seal 418 at the end of the container, such a seal is not required. For example, where the applicator tip does not itself contain a separate application component, and/or where the uppermost compartment 416 does not contain a separate application component, a separate seal need not be provided. Thus, for example, the container and the applicator can be packaged separately, rather than as a single unitary device. Likewise, a kit can be provided having one or more applicators, such as of different sizes or shapes, or constructions, and one or more containers containing the material(s) to be applied.

Figure 24:
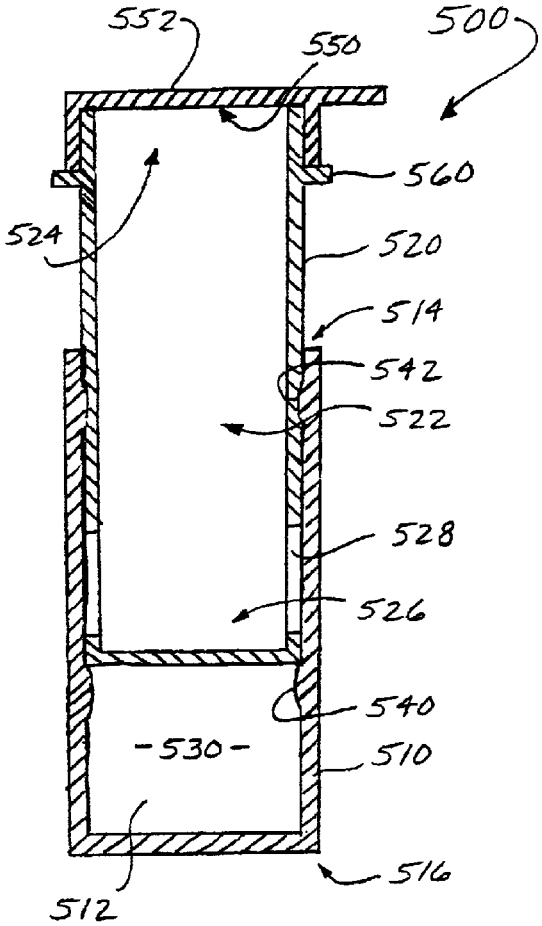
FIGS. 24–25 are cross-sectional views of a sixth embodiment of the present invention illustrating stages of use.
Figure 25:
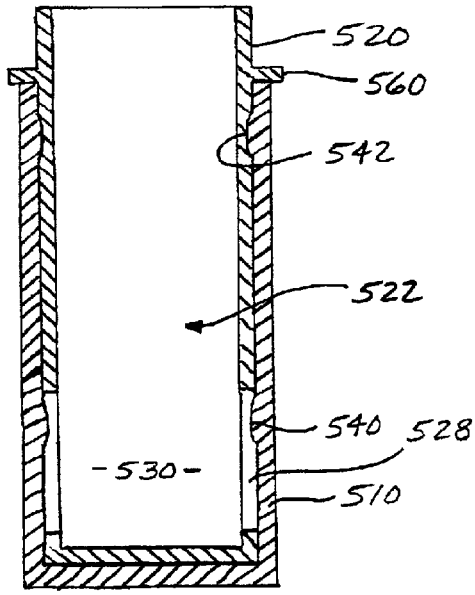

A sixth exemplary embodiment of a single-use dispenser 500 according to the present invention is shown in FIGS. 24–25. A first dispenser element 510 of the dispenser 500 has an open end 514 and a closed end 516. The first dispenser element 510 thus defines a first reservoir 512. A second dispenser element 520 of the dispenser 500 similarly has an open end 524 and a closed end 526, and defines a chamber 522. At least one aperture 528 is disposed between the open end 524 and the closed end 526 of the second dispenser element 520. The aperture 528 opens into the chamber 522.

The dispenser 500 is assembled by fitting at least the closed end 526 of the second dispenser element 520 into the open end 524 of the first dispenser element 510 with an amount of a polymerizable adhesive material 530 contained in the first reservoir 512. Prior to use, the closed end 526 of the second dispenser element 520 is located in a first position, as shown in FIG. 24.

After the dispenser 500 is assembled, both the first reservoir 512 and the chamber 522 are preferably sealed. The first reservoir 512 is sealed by a friction fit between the second dispenser element 520 and a first circumferential ridge portion 540. The first circumferential ridge portion 540 is situated between the closed end 516 of the first dispenser element 510 and the aperture 528 of the second dispenser element 520 when the closed end 526 of the second dispenser element 520 is in the first position. As shown in FIGS. 24 and 25, the first circumferential ridge portion 540 may be disposed on an inner surface of the first dispenser element 510.

The chamber 522 is sealed by a friction fit between the second dispenser element 520 and a second circumferential ridge portion 542 and a seal 550. The seal 550 may comprise a removable cap 552 that fits on the open end 524 of the second dispenser element 520. The second circumferential ridge portion 540 is situated between the open end 514 of the first dispenser element 510 and the aperture 528 of the second dispenser element 520 when the closed end 526 of the second dispenser element 520 is in the first position. As shown in FIGS. 24 and 25, the second circumferential ridge portion 542 may be disposed on an inner surface of the first dispenser element 510.

The dispenser 500 may include a lip 560 near the open end of the second dispenser element 520. The lip 560 is positioned on an outer surface of the second dispenser element 520 so that the lip 560 will contact the first dispenser element 510 when the closed end 526 of the second dispenser element 520 is moved into a second position, as shown in FIG. 25. The lip 560 thus provides a clear visual and/or physical indication that the closed end 526 of the second dispenser element 520 is moved the desired amount in use, as further explained below.

In use, the second dispenser element 520 is pushed into the first dispenser element 510 so that the closed end 526 of the second dispenser element 520 is moved into the second position, as shown in FIG. 25. This forces the polymerizable adhesive material 530, previously contained in the first reservoir 512, into the chamber 522 through the aperture(s) 528.

The removable cap 552 is removed so that an applicator (not shown) can be inserted into the chamber 522 and into the polymerizable adhesive material 530. As with the previously described embodiments, an applicator used with the dispenser 500 may be any suitable applicator. The applicator is then removed from the dispenser 500 so that the polymerizable adhesive material 530 can be applied to a desired surface.

At least the first dispenser element 510 and the closed end of the second dispenser element 520 are preferably made of a material that promotes the stability of the polymerizable adhesive material 530. Furthermore, the entire dispenser 500 may be made of such a material. Suitable materials include the materials described in detail above. In particular, a combination of relatively pure resins, such as Allethon 6017 for the first dispenser element 510 and Marlex 5250 for the second dispenser element 520, is highly desirable for stability of the polymerizable adhesive material 530.

The chamber 522 may contain an initiator or rate modifier to promote polymerization and/or cross-linking of the polymerizable adhesive material 530 in use. Thus, the initiator or rate modifier may be mixed with the polymerizable adhesive material 530 when the polymerizable adhesive material 530 is forced into the chamber 522, as described above, and then simultaneously applied. By indicating that the second dispenser element 520 has been moved the desired amount in use, the lip 560 helps ensure that a proper ratio of initiator to adhesive is obtained. For example, failing to move the second dispenser element 520 the entire desired amount will cause less of the polymerizable adhesive material 530 to be forced into the chamber 522. Thus, the ratio of initiator to adhesive will be higher than desired and the polymerizable adhesive material 530 may polymerize too quickly for the desired application.

Additionally or alternatively, the chamber 522 may contain a medicament, an anesthetic and/or other material to be applied. The dispenser 500 also allows the initiator, rate modifier, medicament, anesthetic and/or other material to be applied prior to application of the polymerizable adhesive material 530. In such a case, the removable cap 552 is removed to break the seal 550 so that an applicator (not shown) can be inserted into the chamber 522 prior to moving the closed end 526 of the second dispenser element 520 into the second position. The initiator, rate modifier, medicament, anesthetic and/or other material is removed from the chamber 522 and then applied to the desired surface.

Thereafter, the second dispenser element 520 is pushed into the first dispenser element 510 so that the closed end 526 of the second dispenser element 520 is moved into the second position, forcing the polymerizable adhesive material 530 into the chamber 522 through the aperture(s) 528. The applicator is reinserted into the chamber 522 and into the polymerizable adhesive material 530. The applicator is then removed from the dispenser 500 so that the polymerizable adhesive material 530 can be applied to the desired surface.

As illustrated by these methods of use, the dispenser 500 allows easy application of the polymerizable adhesive material 530, and a second material as desired, that may be accomplished with one hand. The dispenser 500 maintains the materials in a sealed condition prior to use and preferably leaves no excess adhesive material 530 or other material since the dispenser 500 is designed for a single use.

Furthermore, although the above description is with respect to there being a seal 550 at the open end of the second dispenser element, such a seal is not required. For example, where the chamber 522 does not contain a separate application component a separate seal need not be provided. In such a case, the second circumferential ridge portion 542 may also be omitted.

A kit can be provided having one or more dispensers, such as of different sizes or constructions, containing the material (s) to be applied and one or more applicators, such as of different sizes, shapes or constructions.

Figure 26:
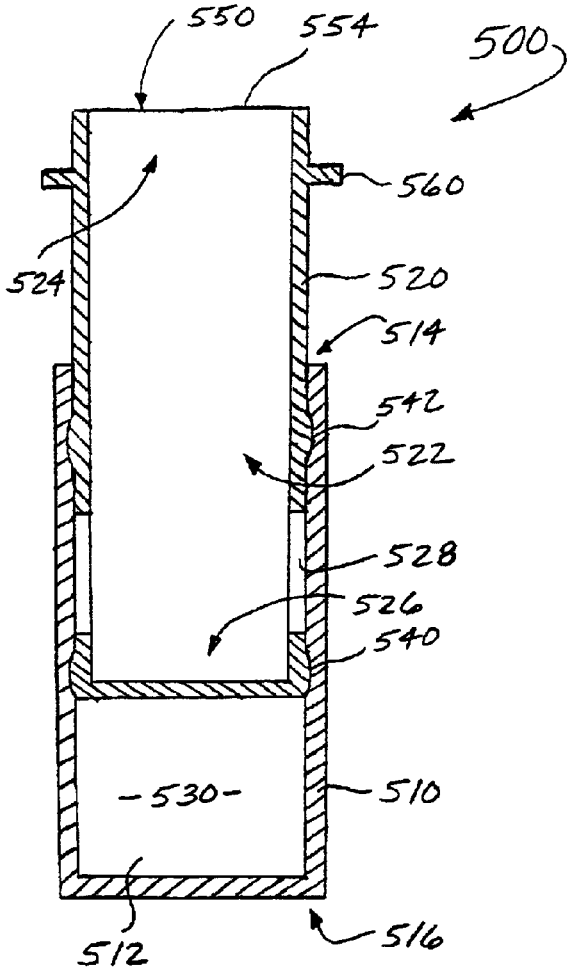
FIGS. 26–27 are cross-sectional views of a modification of the sixth embodiment illustrating stages of use.
Figure 27:
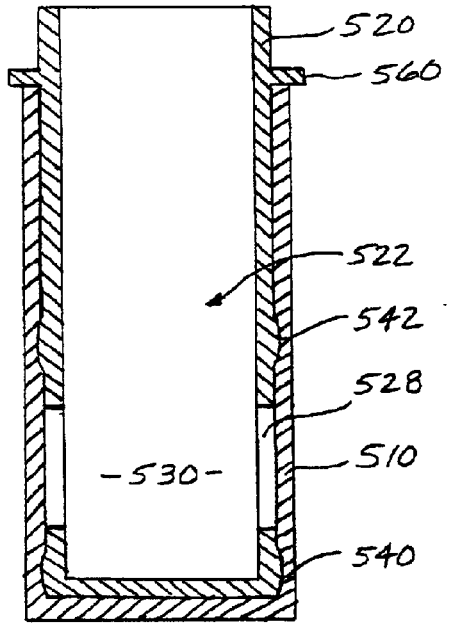

A modification of the sixth exemplary embodiment of a single-use dispenser 500 according to the present invention is shown in FIGS. 26–27. In this modification, the first circumferential ridge portion 540 is disposed on an outer surface of the second dispenser element 520. The second circumferential ridge portion 542 may also be disposed on the outer surface of the second dispenser element 520 as shown. Although not shown, first and second circumferential ridge portions 540 and 542 may alternately be disposed on the inner surface of the first dispenser element 510 and the outer surface of the second dispenser element 520 as desired.

Figure 28:
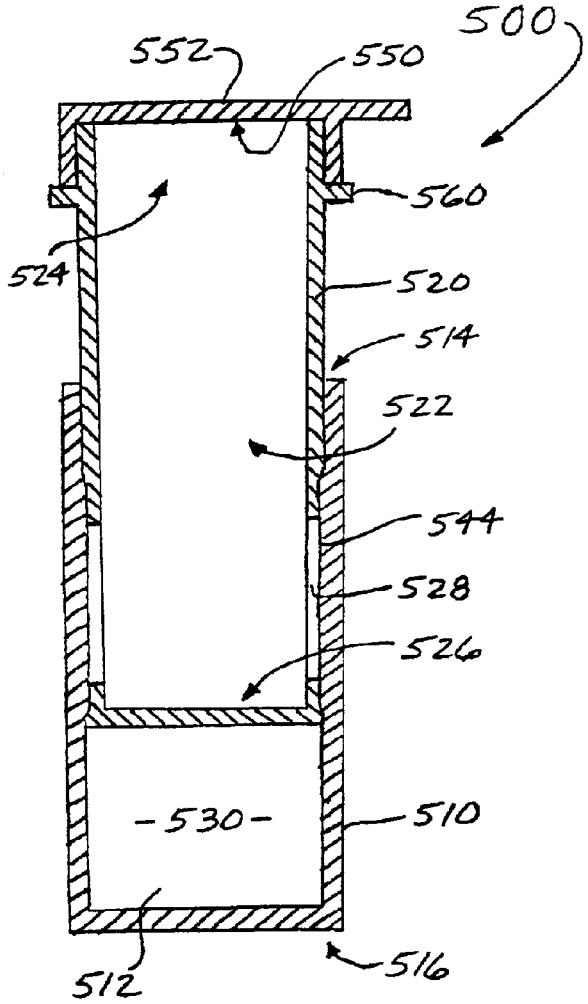
FIGS. 28–29 are cross-sectional views of another modification of the sixth embodiment illustrating stages of use.
Figure 29:
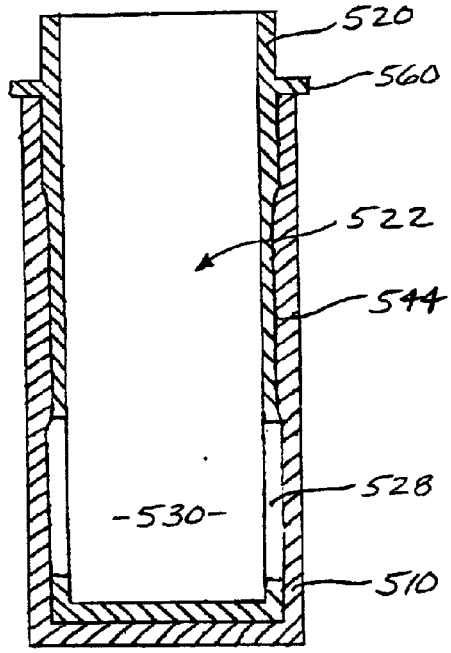

Another modification of the sixth exemplary embodiment of a single-use dispenser 500 according to the present invention is shown in FIGS. 28–29. In this modification, both the first and second circumferential ridge portions are disposed on the inner surface of the first dispenser element 510 to form a continuous circumferential ridge 544. Both modifications, as well as others, can be used as described above with respect to FIGS. 24–25.

Figure 32:
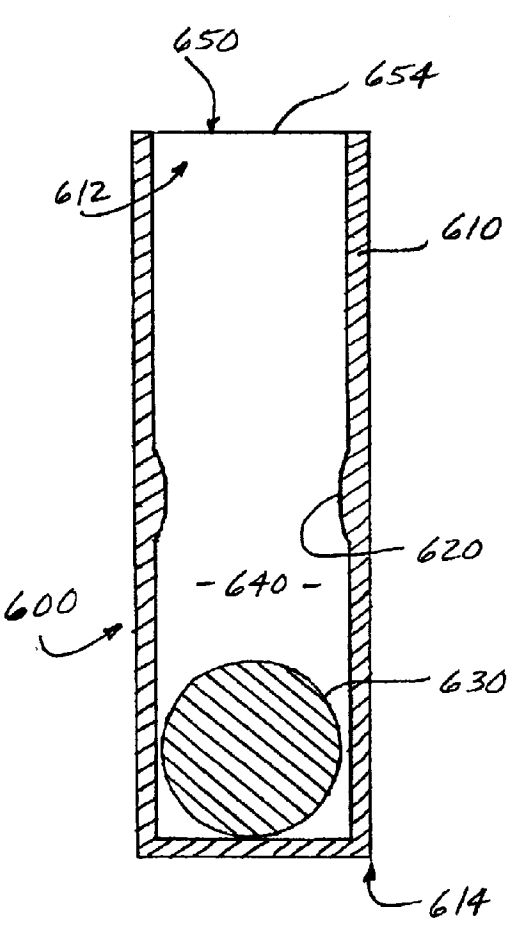
FIGS. 30–32 are cross-sectional views of a seventh embodiment of the present invention illustrating stages of use.
Figure 31:
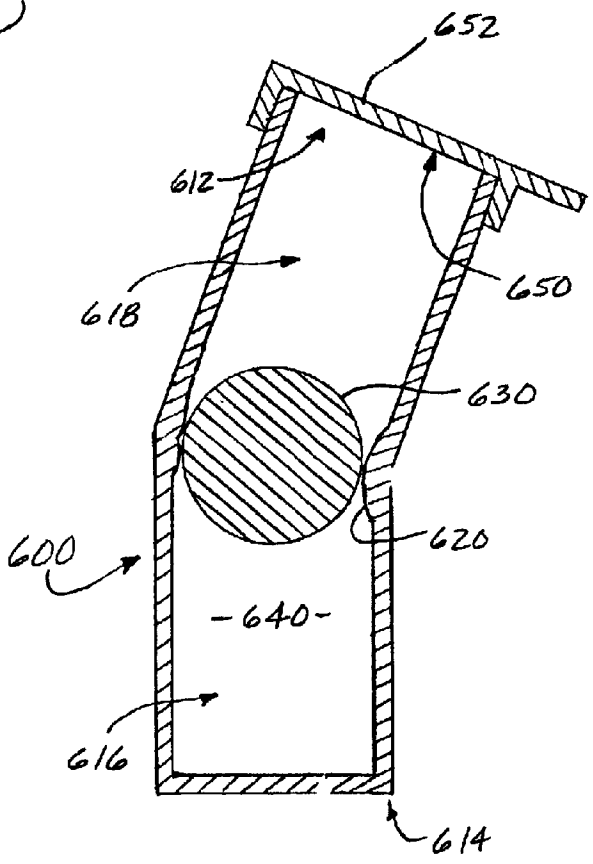
Figure 30:
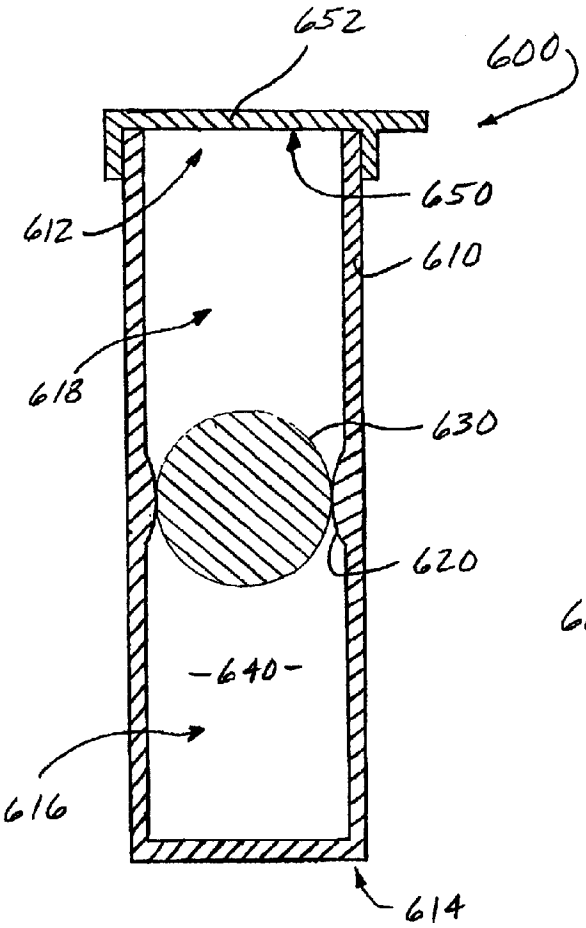

A seventh exemplary embodiment of a single-use dispenser 600 according to the present invention is shown in FIGS. 30–32. A dispenser element 610 of the dispenser 600 has an open end 612 and a closed end 614. The dispenser element 610 thus defines a first reservoir 616. An amount of a polymerizable adhesive material 640 is contained in the first reservoir 616. The first reservoir 616 is sealed by a friction fit between a circumferential ridge portion 620 and a stopper element 630. The circumferential ridge portion 620 is situated between the closed end 614 and the open end 612 of the dispenser element 610. As shown in FIGS. 30–32, the circumferential ridge portion 620 is disposed on an inner surface of the dispenser element 610.

A chamber 618 is defined between the stopper element 630 and the open end 612 of the dispenser element 610. A seal 650 is preferably disposed at the open end 612 to seal the chamber 618 and form a second reservoir. The seal 650 may comprise a removable cap 652 that fits on the open end 612 of the dispenser element 610, as shown in FIGS. 30 and 31. Alternatively, the seal 650 may comprise a frangible barrier 654, as shown in FIG. 32.

In use, the circumferential ridge portion 620 is deformed to release the stopper element 630. This may be accomplished by compressing the circumferential ridge portion 620 into the stopper element 630 or by bending the dispenser element 610 about the stopper element 630, as shown in FIG. 31. Once the stopper element 630 is freed from the circumferential ridge portion 620, the polymerizable adhesive material 640 may flow around the stopper element 630, allowing the stopper element 630 to move, either gravitationally or with the application of a pressing force, toward the closed end 614 of the dispenser element 610, as shown in FIG. 32. The removable cap 652 is removed or the frangible barrier 654 is ruptured so that an applicator (not shown) can be inserted into the dispenser element 610 and into the polymerizable adhesive material 640. As with the previously described embodiments, an applicator used with the dispenser 600 may be any suitable applicator. The applicator is then removed from the dispenser 600 so that the polymerizable adhesive material 640 can be applied to a desired surface.

At least the dispenser element 610, the stopper element 630 and the circumferential ridge portion 620 are preferably made of a material that promotes the stability of the polymerizable adhesive material 640. Furthermore, the entire dispenser 600 may be made of such a material. Suitable materials include the materials described in detail above.

The chamber 618 may contain an initiator or rate modifier to promote polymerization and/or cross-linking of the polymerizable adhesive material 640 in use. Thus, the initiator or rate modifier may be mixed with the polymerizable adhesive material 640 when the polymerizable adhesive material 640 is allowed to flow around the stopper element 630, as described above, and then simultaneously applied. Additionally or alternatively, the chamber 618 may contain a medicament, an anesthetic and/or other material to be applied.

The dispenser 600 also allows the initiator, rate modifier, medicament, anesthetic and/or other material to be applied prior to application of the polymerizable adhesive material 640. In such a case, the removable cap 652 is removed or the frangible barrier 654 is ruptured to break the seal 650 so that an applicator (not shown) can be inserted into the dispenser element 610 prior to deforming the circumferential ridge portion 620. The initiator, rate modifier, medicament, anesthetic and/or other material is removed from the chamber 618 and then applied to the desired surface.

Thereafter, the circumferential ridge portion 620 is deformed to release the stopper element 630, allowing the polymerizable adhesive material 640 to flow around the stopper element 630. The applicator is reinserted into the dispenser element 610 and into the polymerizable adhesive material 640. The applicator is then removed from the dispenser 600 so that the polymerizable adhesive material 640 can be applied to the desired surface.

As illustrated by these methods of use, the dispenser 600 allows easy application of the polymerizable adhesive material 640, and a second material as desired, that may be accomplished with one hand. The dispenser 600 maintains the materials in a sealed condition prior to use and preferably leaves no excess adhesive material 640 or other material since the dispenser 600 is designed for a single use.

Furthermore, although the above description is with respect to there being a seal 650 at the open end 612 of the dispenser element 610, such a seal is not required. For example, where the chamber 618 does not contain a separate application component a separate seal need not be provided.

A kit can be provided having one or more dispensers, such as of different sizes or constructions, containing the material (s) to be applied and one or more applicators, such as of different sizes, shapes or constructions.

Figure 33:
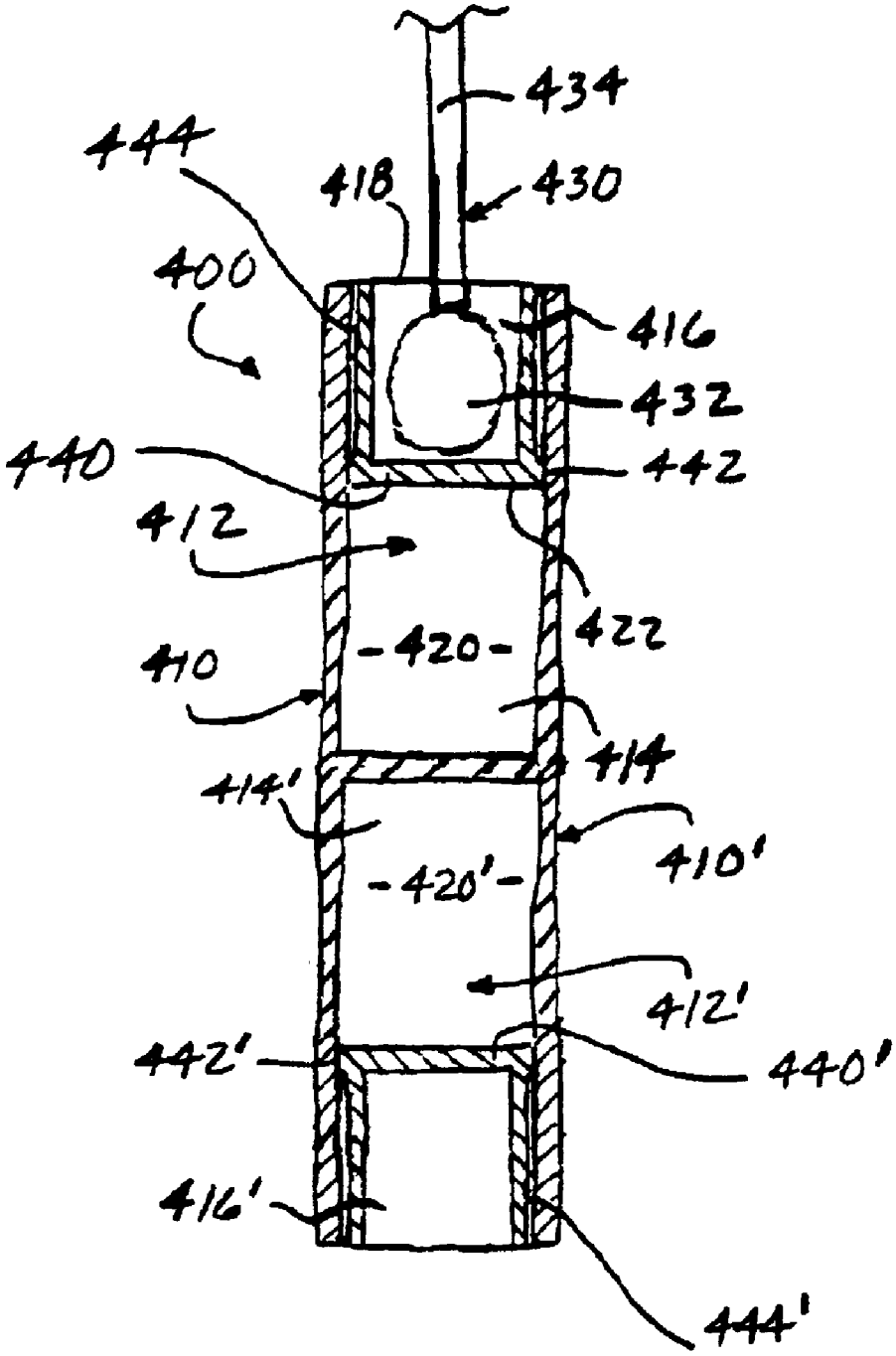
FIG. 33 is a cross-sectional view of an exemplary modification of the fifth embodiment.

The applicator assemblies and dispensers of the present invention may be modified for particular applications. For example, as shown in FIG. 33, the single-use applicator assembly 400 according to the fifth embodiment may be modified to include additional structure that mirrors the structure shown in FIGS. 18–23. Although described with respect to the fifth embodiment, it should be understood that the sixth and seventh embodiments may be similarly modified.

As shown in FIG. 33, the single-use applicator assembly 400 is modified to include a second base portion 410' also having at least one compartment 412'. A second plunger 440' divides the at least one compartment 412' into a third compartment 414' that contains, for example, a medicament material 420' and a fourth compartment 416'. The applicator 430 may be partially disposed in either the second compartment 416 or the fourth compartment 416'. The second plunger 440' contacts the second base portion 410' at least at a second portion 442' of the second plunger 440'. A second channel 444' is formed on an outer wall of the second plunger 440'.

In the exemplary embodiment shown in FIG. 33, at least the first and third compartments 414, 414' are preferably sealed. The second portion 442' of the second plunger 440' seals against the second base portion 410' by a friction fit when in the position shown in FIG. 33. As with the previously described embodiments, the applicator 430 may be any suitable applicator. In particular, the applicator 430 may be double-ended to have a second swab tip at the opposite end of the swab handle 434 from the swab tip 432.

Use of this modification is similar to that of the fifth embodiment described with reference to FIGS. 18–23. The steps used to apply the material 420 contained in the first compartment 412 are repeated for application of the material 420' contained in the third compartment 412'.

The applicator assemblies and dispensers of the present invention may be used to apply the polymerizable adhesive composition to a variety of substrates for the purposes of protecting, sealing, and bonding surfaces together. Suitable substrates include, but are not limited to, metals, plastics, rubbers, wood, ceramics, fabrics, cement, paper, living tissue and the like. For example, the polymerizable and/or cross-linkable material may be useful as tissue adhesives, sealants for preventing bleeding or for covering open wounds, systems for delivery of therapeutic or other bioactive agents, and other biomedical applications. They find uses in, for example, closing surgically incised or traumatically lacerated tissues; setting fractured bone structures; retarding blood flow from wounds; aiding repair and regrowth of living tissues; providing implantable matrixes for delivering bioactive agents; dressing burns; dressing skin or other superficial or surface wounds (such as abrasions, chaffed or raw skin, and/or stomatitis); protecting tissues prone to damage (e.g., as artificial calluses); and providing structural implants.

The polymerizable adhesive composition, in embodiments, is preferably a monomeric (including prepolymeric) adhesive composition. In embodiments, the monomer is a 1,1-disubstituted ethylene monomer, e.g., an (α-cyanoacrylate. Preferred monomer compositions of the present invention, and polymers formed therefrom, are useful as tissue adhesives, sealants for preventing bleeding or for covering open wounds, and in other absorbable and non-absorbable biomedical applications. They find uses in, for example, apposing surgically incised or traumatically lacerated tissues; retarding blood flow from wounds; drug delivery; dressing burns; dressing skin or other superficial or surface wounds (such as abrasions, chaffed or raw skin, and/or stomatitis); hernia repair; meniscus repair; and aiding repair and regrowth of living tissue. Other preferred monomer compositions of the present invention, and polymers formed therefrom, are useful in industrial and home applications, for example in bonding rubbers, plastics, wood, composites, fabrics, and other natural and synthetic materials.

The monomer (including prepolymeric) adhesive composition may include one or more polymerizable monomers. Preferred monomers that may be used in this invention are readily polymerizable, e.g. anionically polymerizable or free radical polymerizable, or polymerizable by zwitterions or ion pairs to form polymers. Such monomers include those that form polymers, that may, but do not need to, biodegrade. Such monomers are disclosed in, for example, U.S. Pat. Nos. 5,328,687 and 5,928,611 to Leung et al., U.S. patent application Ser. No. 09/430,177, filed on Oct. 29, 1999, and U.S. patent application Ser. No. 09/471,392 filed Dec. 23, 1999, which are hereby incorporated in their entirety by reference herein. Preferred monomers include 1,1-disubstituted ethylene monomers, such as α-cyanoacrylates including, but not limited to, alkyl α-cyanoacrylates having an alkyl chain length of from about 1 to about 20 carbon atoms or more, preferably from about 2 to about 12 or more preferably from about 3 to about 8 carbon atoms.

The α-cyanoacrylates of the present invention can be prepared according to several methods known in the art. U.S. Pat. Nos. 2,721,858, 3,254,111, 3,995,641, and 4,364,876, each of which is hereby incorporated in its entirety by reference herein, disclose methods for preparing α-cyanoacrylates.

As desired, the application according to the present invention can include any of a wide variety of additional materials, either mixed into the polymerizable composition, or in a separate compartment from the polymerizable composition. Examples of suitable additional materials include, but are not limited to, plasticizing agents, thixotropic agents, thickeners, natural or synthetic rubbers, stabilizers, pH modifiers, bioactive agents, cross-linking agents, chain transfer agents, fibrous reinforcements, colorants, preservatives, formaldehyde reducing or scavenging agents, flavorants, perfumes, mixtures thereof, and the like.

The composition may optionally also include at least one other plasticizing agent that assists in imparting flexibility to the polymer formed from the monomer. The plasticizing agent preferably contains little or no moisture and should not significantly affect the stability or polymerization of the monomer. Examples of suitable plasticizers include but are not limited to tributyl citrate, acetyl tri-n-butyl citrate (ATBC), polymethylmethacrylate, polydimethylsiloxane, hexadimethylsilazane, isopropyl myristate, isopropyl palmitate, and others as listed in U.S. patent application Ser. No. 09/471,392 filed Dec. 23, 1999, the disclosure of which is incorporated in its entirety by reference herein.

The composition may also optionally include at least one thixotropic agent. Suitable thixotropic agents are known to the skilled artisan and include, but are not limited to, silica gels such as those treated with a silyl isocyanate, and optionally surface treated titanium dioxide. Examples of suitable thixotropic agents and thickeners are disclosed in, for example, U.S. Pat. No. 4,720,513, and U.S. patent application Ser. No. 09/374,207 filed Aug. 12, 1999, the disclosures of which are hereby incorporated in their entireties by reference herein.

The composition may optionally also include thickeners. Suitable thickeners may include poly (2-ethylhexy methacrylate), poly(2-ethylhexyl acrylate) and others as listed in U.S. patent application Ser. Nos. 09/471,392 filed Dec. 23, 1999, and 09/374,207, filed Aug. 12, 1999, the disclosures of which are incorporated by reference herein in their entirety.

The composition may also optionally include at least one natural or synthetic rubber to impart impact resistance. Suitable rubbers are known to the skilled artisan. Such rubbers include, but are not limited to, dienes, styrenes, acrylonitriles, and mixtures thereof. Examples of suitable rubbers are disclosed in, for example, U.S. Pat. Nos. 4,313,865 and 4,560,723, the disclosures of which are hereby incorporated in their entireties by reference herein.

The composition may optionally also include one or more stabilizers, preferably both at least one anionic vapor phase stabilizer and at least one anionic liquid phase stabilizer. The composition may optionally also include, in addition to or in place of the anionic stabilizers, at least one free radical stabilizer. These stabilizing agents may inhibit premature polymerization. Suitable anionic and free radical stabilizers may include those listed in U.S. patent application Ser. Nos. 09/471,392 filed on Dec. 23, 1999, and 09/099,457, filed Jun. 18, 1998, the disclosures of which are incorporated by reference herein in their entirety.

However, as described above, a particular advantage of the present invention, such as in embodiments where stabilizing packaging is used, is that separate stabilizers can be omitted form the composition. Thus, in embodiments, the polymerizable composition preferably does not include any, or at least substantially none, additional stabilizer.

The compositions may also include pH modifiers to control the rate of degradation of the resulting polymer, as disclosed in U.S. patent application Ser. No. 08/714,288, filed Sep. 18, 1996, the entire disclosure of which is hereby incorporated by reference herein in its entirety.

Compositions of the present invention may also include at least one biocompatible agent effective to reduce active formaldehyde concentration levels produced during in vivo biodegradation of the polymer (also referred to herein as "formaldehyde concentration reducing agents"). Preferably, this component is a formaldehyde scavenger compound. Examples of formaldehyde scavenger compounds useful in this invention include sulfites; bisulfites; mixtures of sulfites and bisulfites, etc. Additional examples of formaldehyde scavenger compounds useful in this invention and methods for their implementation can be found in U.S. Pat. Nos. 5,328,687, 5,514,371, 5,514,372, 5,575,997, 5,582,834 and 5,624,669, all to Leung et al., which are hereby incorporated herein by reference in their entireties.

To improve the cohesive strength of adhesives formed from the compositions of this invention, difunctional monomeric cross-linking agents may be added to the monomer compositions of this invention. Such crosslinking agents are known. U.S. Pat. No. 3,940,362 to Overhults, which is hereby incorporated herein in its entirety by reference, discloses exemplary cross-linking agents.

The compositions of this invention may further contain fibrous reinforcement and colorants such as dyes, pigments, and pigment dyes. Examples of suitable fibrous reinforcement include PGA microfibrils, collagen microfibrils, and others as described in U.S. patent application Ser. No. 09/471,392 filed on Dec. 23, 1999, the disclosure of which is incorporated by reference herein in its entirety.

The polymerizable compositions useful in the present invention may also further contain one or more preservatives, for prolonging the storage life of the composition. Suitable preservatives, and methods for selecting them and incorporating them into adhesive compositions, are disclosed in U.S. patent application Ser. No. 09/430,180, the entire disclosure of which is incorporated herein by reference.

In embodiments of the present invention, the composition and/or its applicator or dispenser may contain additional materials such as a polymerization initiator, accelerator, rate-modifier, and/or cross-linking agent for initiating polymerization and/or cross-linking of the polymerizable monomer material. Such initiators, accelerators, rate-modifiers, and/or cross-linking agents can be included in the applicator tip, in the polymerizable composition, and/or elsewhere, as appropriate.

In embodiments of the present invention, particularly where the adhesive monomer composition is not in contact with the applicator tip in the assembly, it is possible to incorporate into the applicator tip additional components, such as polymerization initiators and/or accelerators, anesthetic, medicament or the like, or even any of the various additives described above with respect to the polymerizable composition. This is advantageous, for example, where additional initiator or accelerator may be necessary to provide the desired cure rate of the adhesive once it is applied or where additional treatment is desired. Furthermore, this is advantageous in embodiments where additional stabilizers or polymerization inhibitors must be added to the adhesive composition in the assembly, so as to overcome the "cure speed loss" that often occurs when such stabilizing agents are added.

In embodiments, the initiator or accelerator material is an initiator and/or a rate modifier for polymerization and/or cross-linking of a polymerizable monomer. As used herein, a polymerization initiator is any material that causes a monomer composition applied to a substantially dry tissue (i.e., substantially in the absence of plasma or like tissue fluids) to polymerize in less than 300 seconds at ambient temperature, for example, at approximately 21–25° C. Preferably, the initiator causes the monomer composition to polymerize in less than 150 seconds at ambient temperature, more preferably within 60, 90 or 130 seconds. As used herein, a polymerization rate modifier is any material that changes the rate at which a polymerizable monomer would polymerize in the absence of that material. Preferably, the rate modifier accelerates the rate of the polymerization reaction, although for particularly fast-acting monomers it may decelerate that rate.

The material may be applied to the applicator tip, for example, by spraying, dipping, injecting, or brushing the applicator tip with a liquid medium containing the polymerization initiator or accelerator. It is preferably applied to the tip by dipping or injecting. For example, it may be applied to the tip by pumping of the liquid medium, for example, through a syringe, onto the tip. Methods of applying the polymerization initiator or accelerator to an applicator tip are described in more detail in U.S. Pat. No. 5,928,611 to Leung and U.S. patent application Ser. Nos. 09/069,979, filed Apr. 30, 1998, 08/920,876, filed Aug. 29, 1997, and 09/430,177, filed Oct. 29, 1999, the entire disclosures of which is incorporated herein by reference.

As described above, an advantage of the present invention is that the applicators and dispensers can be provided in various single-use sizes, based on the desired or intended uses of the adhesive compositions. In such embodiments, the applicator tip size and/or the amount of polymerizable adhesive composition can be selected from various alternatives. This concept further applies to the amount of polymerization initiator or accelerator that can be added. For example, in embodiments where polymerization initiator or accelerator is added to the applicator tip, the amount can be adjusted based on the desired or intended uses of the adhesive compositions. Thus, for example, where an application would require only a small amount of adhesive composition, a correspondingly small amount of initiator or accelerator can be applied to an appropriately sized applicator tip; likewise, where an application would require a larger amount of adhesive composition, a correspondingly larger amount of initiator or accelerator can be applied to an appropriately larger applicator tip.

Particular initiators and accelerators for particular monomers may be readily selected by one of skill in the art without undue experimentation. Control of the molecular weight distribution of the applied adhesive can be enhanced by selection of the concentration and functionality of the initiator or accelerator vis-a-vis the selected monomer. Suitable polymerization initiators and accelerators for cyanoacrylate compositions include, but are not limited to, detergent compositions; surfactants, including nonionic surfactants such as polysorbate 20 (e.g., Tween 20™; ICI Americas), polysorbate 80 (e.g., Tween 80™; ICI Americas), and poloxamers; cationic surfactants such as tetrabutylammonium bromide; anionic surfactants, including quaternary ammonium halides such as benzalkonium chloride or its pure components, and benzethonium chloride; stannous octoate (tin (II) 2-ethylhexanoate), and sodium tetradecyl sulfate; and amphoteric or zwitterionic surfactants such as dodecyldimethyl(3-sulfopropyl) ammonium hydroxide, inner salt; amines, imines, and amides, such as imidazole, tryptamine, urea, arginine and povidine; phosphines, phosphites and phosphonium salts, such as triphenylphosphine and triethyl phosphite; alcohols such as ethylene glycol; methyl gallate; inorganic bases and salts, such as sodium bisulfite, magnesium hydroxide, calcium sulfate and sodium silicate; sulfur compounds such as thiourea and polysulfides; polymeric cyclic ethers such as monensin, nonactin, crown ethers, calixarenes and polymeric epoxides; cyclic and acyclic carbonates, such as diethyl carbonate; phase transfer catalysts such as Aliquat™ 336 (General Mills, Inc., Minneapolis, Minn.); organometallics; manganese acetylacetonate; radical initiators and radicals, such as di-t-butyl peroxide and azobisisobutyronitrile; and bioactive compounds or agents.

In preferred embodiments, the initiator may be a bioactive material, including quaternary ammonium halides such as alkylbenzyldimethylammoniunm chloride (benzalkonium chloride; BAC) its pure components, or mixtures thereof, especially those with an alkyl containing 6–18 carbon atoms; benzethonium chloride; and salts of sulfadiazine. Cobalt napthenate can be used as an accelerator for peroxide. Other suitable bioactive materials are disclosed in U.S. Pat. No. 5,928,611 to Leung and U.S. patent application Ser. Nos. 08/920,876, filed Aug. 29, 1997, 09/430,176 filed Oct. 29, 1999, and 09/430,177, filed Oct. 29, 1999, the entire disclosures of which is incorporated herein by reference.

The polymerizable adhesive compositions according to the invention can also comprise a medicament. Inclusion of a medicament is often desirable in compositions intended for medical applications. The medicament can either be added to the monomer-containing adhesive composition prior to packaging, or, alternatively, to the applicator tip or a separate compartment. Thus, the medicament may be applied to a tissue prior to or simultaneously with application of the monomer-containing adhesive composition. In addition to serving its medicinal function, the medicament may be selected so that it functions in conjunction with the copackaged polymerizable monomer composition to initiate polymerization of the monomer or modify (e.g., accelerate) the rate of polymerization for the monomer to form a polymeric adhesive. The proper combination of medicament and polymerizable monomer can be determined easily by one of skill in the art. The medicament is supplied in an amount that will be pharmaceutically effective when applied topically (i.e., directly to tissue).

Examples of such medicaments include, but are not limited to antibiotics, antimicrobials, antiseptics, bacteriocins, bacteriostats, disinfectants, steroids, anesthetics, fungicides, anti-inflammatory agents, antibacterial agents, antiviral agents, antitumor agents, growth promoters, and mixtures thereof.

Exemplary medicaments include, but are not limited to, quatemary ammonium halides such as benzalkonium chloride and benzethonium chloride; chlorhexidine sulfate; gentamicin sulfate; hydrogen peroxide; quinolone thioureas; silver salts, including, but not limited to, silver acetate, silver benzoate, silver carbonate, silver chloride, silver citrate, silver iodide, silver nitrate, and silver sulfate; sodium hypochlorite; salts of sulfadiazine, including, but not limited to silver, sodium, and zinc salts; and mixtures thereof.

Preferable medicaments are those that are anions or help in radical generation or that are ion pairs or are themselves radicals.

In embodiments, the medicament is preferably a quaternary ammonium halide such as alkylbenzyldimethylammonium chloride (benzalkonium chloride; BAC) with an alkyl containing 6–18 carbon atoms, its pure components, or mixtures thereof, or benzethonium chloride; or a salt of sulfadiazine, such as a silver, sodium, or zinc salt.

The medicament can have a pharmaceutical effect only at the site of application (i.e., limited to the tissue on/in which it is applied), or it can have a systemic effect (by systemic, it is not only meant that the medicament has an effect throughout the patient's body, but also at a specific site other than the site of application). In embodiments where the medicament is applied in an amount sufficient to show a systemic pharmaceutical activity, it can be absorbed, transported, or otherwise distributed to the site or sites within the patient where the pharmaceutical activity is desired, e.g., through the cardiovascular or lymph systems. The medicament may be in the form of a solid, such as a powder or a solid film, or in the form of a liquid, such as a watery, viscous, or paste-like material. The medicament may also be compounded with a variety of additives, such as surfactants or emulsifiers, and vehicles.

The polymerizable and/or cross-linkable material may be neat (no additional compounds added) or in a solvent, emulsion or suspension. Suitable solvents according to the present invention include alcohol, ether alcohol, hydrocarbons, halogenated hydrocarbons, ethers, acetals, ketones, esters, acids, sulfur-or nitrogen-containing organic compounds, mixtures thereof and the like. Other suitable solvents are disclosed in U.S. Pat. No. 5,130,369 to Hughes et al. and U.S. Pat. No. 5,216,096 to Hattori et al., the entire disclosures of which are incorporated herein by reference. These solvents may be used either independently or in combination of two or more. They may also be used in conjunction with water to the extent that the polymerizable and/or cross-linkable material is dissolved or suspended in such a mixture. The total amount of solvent that may be incorporated into the polymerizable and/or cross-linkable material may be 0 to 99, preferably 1 to 50, and more preferably 3 to 25 percent by weight. Selection of the amount will, of course, depend on the desired monomer and process conditions, and amounts outside these ranges may be acceptable.

In embodiments, the monomer composition and/or its packaging are preferably sterilized. Sterilization of the monomer composition and/or its packaging can be accomplished by techniques known to one of ordinary skill in the art, and is preferably accomplished by methods including, but not limited to, chemical, physical, and/or irradiation methods. Examples of chemical methods include, but are not limited to, exposure to ethylene oxide or hydrogen peroxide vapor. Examples of physical methods include, but are not limited to, sterilization by heat (dry or moist) or retort canning. Examples of irradiation methods include, but are not limited to, gamma irradiation, electron beam irradiation, and microwave irradiation. A preferred method is electron beam irradiation, as described in U.S. patent application Ser. No. 09/025,472, filed on Feb. 18, 1998, the entire disclosure of which is incorporated herein by reference. The composition must show low levels of toxicity to living tissue during its useful life. In preferred embodiments of the present invention, the composition is sterilized to provide a Sterility Assurance Level (SAL) of at least $10^{-3}$. In embodiments, the Sterility Assurance Level may be at least $10^{-4}$, or may be at least $10^{-5}$, or may be at least $10^{-6}$.

The polymerizable adhesive composition according to the invention can be manufactured and sterilized in very small quantities. Typically, sterilized α-cyanoacrylate compositions are sterilized in large volumes (e.g., 1–5 milliliters). When intended for medical applications, this large volume is undesirable because much of the composition is discarded after the first use out of fear of contamination of the composition. Thus, providing sterile α-cyanoacrylate compositions in smaller volumes is desirable. Thus, the sterilized compositions of embodiments of the invention provide an improvement over the sterile compositions currently available.

Preferably, a polymerizable adhesive composition according to the invention is packaged such that a total volume of no more than 1 mL of the adhesive composition is present per package (i.e., container). More preferably, no more than 0.6 ml. of the adhesive composition is present. As noted above, such compositions of the invention can be sterilized by appropriate means, including, but not limited to, dry heat sterilization, gamma irradiation, microwave irradiation, and electron beam irradiation.

In embodiments where the compositions are to be used for medical applications, the sterilized composition must show low levels of toxicity to living tissue during its useable life. For example, sterilized compositions according to embodiments of the present invention show an increase in viscosity of no more than 300% as a result of sterilization. Viscosity levels can be determined by known techniques. For example, viscosity can be determined at room temperature (approximately 21–25° C.) using a Brookfield Cone-Plate Viscometer with spindle size CP-40. The instrument is standardized using a Viscosity Reference Standard in the same range as the sample to be tested. Each sample is measured three times, and an average value determined and recorded.

To be considered sterile, the polymerizable adhesive composition should show no bacterial growth after inoculation onto Soybean Casein Digest media, and incubation for 14 days at 32–35° C. Standard procedures and materials, such as those disclosed in USP XXIII<1211>, "Sterilization and Sterility Assurance of Compendial Articles" should be followed.

Preferably, the polymerizable adhesive composition has, immediately after sterilization, a viscosity level no more than 15–20% higher than the level prior to sterilization. However, the acceptable viscosity can be as high as 200% higher than the level prior to sterilization. More preferably, the sterilized composition has a viscosity that is no more than 50% higher than the viscosity of the composition before sterilization. Most preferably, the composition has a viscosity that is essentially unchanged from the level prior to sterilization (i.e., less than 20% higher). The acceptable viscosity after sterilization will need to be below 200% higher than the initial value in order for the monomeric adhesive composition to be of high utility in the application for which it is intended. In general, the increase in viscosity during sterilization can be viewed as "premature" aging of the monomer-containing composition, which reduces its useful shelf life, particularly when it is not stored at reduced temperature. In addition, the change in the viscosity is also an indication of a change in the reactivity of the monomeric composition, which normally is not desired.

In preferred embodiments, there is substantially no initiation of polymerization of monomeric liquid adhesive compositions that affects the utility of the monomer or monomers caused by the sterilization process. The sterilized liquid adhesive compositions have a good shelf life and excellent stability.

It should be understood that the individual features of the various exemplary embodiments may be included or excluded as desired for a given application. As such, all possible combinations of the described features are considered to be encompassed by the present invention.

Thus, while the present invention has been described in terms of exemplary embodiments, it is to be understood that the present invention is not to be limited to the particular configuration of these embodiments. One skilled in the art will recognize that various modifications and/or alterations of these embodiments may be made while remaining within the scope of the present invention.

What is claimed is:

1. A single-use applicator assembly for dispensing and applying a polymerizable monomeric adhesive material, comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein removal of at least one of the applicator and the adhesive material requires the applicator assembly to be destructively unsealed; and wherein the base portion is formed from a material that stabilizes the polymerizable monomeric adhesive material in the absence of stabilizers being added to the adhesive material.

2. The applicator assembly according to claim 1, wherein the base portion is formed from a halogenated polymeric material.

3. The applicator assembly according to claim 2, wherein the halogenated polymeric material is selected from the group consisting of polyolefins, halogenated hydrocarbons, and engineered resins.

4. The applicator assembly according to claim 2, wherein the halogenated polymeric material is a fluorinated polymeric material.

5. The applicator assembly according to claim 1, wherein the tip of the applicator comprises a material selected from the group consisting of metal, glass, paper, ceramics and cardboard.

6. The applicator assembly according to claim 1, wherein the tip of the applicator comprises a plastic material.

7. The applicator assembly according to claim 1, wherein the tip of the applicator comprises one of a rolling ball, a brush, and a swab.

8. The applicator assembly according to claim 1, wherein the adhesive material is sterilized.

9. The applicator assembly according to claim 8, wherein the tip of the applicator is sterilized.

10. The applicator assembly according to claim 1, wherein the sealed compartment maximizes a ratio of a surface area of an enclosed space of the sealed compartment to a volume of the adhesive material contained therein.

11. A method of applying an adhesive material, comprising:

destructively opening an applicator assembly according to claim 1;

removing the applicator from the at least one compartment; and directly applying the adhesive to a substrate to be bonded.

12. The method of claim 11, wherein the substrate to be bonded is tissue.

13. A single-use applicator assembly for dispensing and applying a polymerizable monomeric adhesive material, comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein the applicator assembly is destructively unsealed by removal of the applicator; and wherein at least the portion of the applicator that is disposed in the compartment is formed from a material that stabilizes the polymerizable monomeric adhesive material.

14. The applicator assembly according to claim 13, wherein the tip of the applicator is made from a same material as the base portion.

15. The applicator assembly according to claim 13, wherein the tip of the applicator is at least one of porous, absorbent and adsorbent in nature.

16. The applicator assembly according to claim 15, wherein the adhesive material is absorbed or adsorbed into the applicator tip.

17. The applicator assembly according to claim 15, wherein a medicament is absorbed or adsorbed into the applicator tip.

18. The applicator assembly according to claim 13, wherein the at least one sealed compartment comprises a first compartment and a second compartment, the first and second compartments being open to each other, the polymerizable monomeric adhesive material being contained in the first compartment and the applicator being at least partially disposed in the second compartment.

19. A method of applying an adhesive material, comprising destructively opening an applicator assembly according to claim 13;

removing the applicator from the at least one compartment; and applying the adhesive to a substrate to be bonded.

20. The method of claim 19, wherein the substrate to be bonded is tissue.

21. A single-use applicator assembly for dispensing and applying a polymerizable monomeric adhesive material, comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein removal of the applicator requires the at least one sealed compartment containing the polymerizable monomeric adhesive material to be destructively unsealed; and wherein the at least one sealed compartment comprises a first sealed compartment and a second sealed compartment, the first and second compartments being separated, the polymerizable monomeric adhesive material being contained in the first compartment and the applicator being at least partially disposed in the second compartment.

22. The applicator assembly according to claim 21, further comprising a polymerization initiator or accelerator for the adhesive material disposed in the second compartment.

23. The applicator assembly according to claim 22, wherein the polymerization initiator or accelerator is disposed in or on the tip of the applicator.

24. The applicator assembly according to claim 23, wherein the tip of the applicator is at least one of porous, absorbent and adsorbent in nature.

25. The applicator assembly according to claim 24, wherein the polymerization initiator or accelerator is absorbed or adsorbed into the tip of the applicator.

26. The applicator assembly according to claim 21, further comprising a medicament disposed in the second compartment.

27. The applicator assembly according to claim 26, wherein medicament is disposed in or on the tip of the applicator.

28. The applicator assembly according to claim 26, wherein the tip of the applicator is at least one of porous, absorbent and adsorbent in nature.

29. The applicator assembly according to claim 28, wherein the medicament is absorbed or adsorbed into the tip of the applicator.

30. A method of applying an adhesive material, comprising:

destructively opening an applicator assembly according to claim 21;

removing the applicator from the second compartment;

applying adhesive to the applicator; and applying the adhesive to a substrate to be bonded.

31. The method of claim 30, wherein the substrate to be bonded is tissue.

32. A single-use applicator assembly for dispensing and applying a polymerizable monomeric adhesive material, comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein removal of at least one of the applicator and the adhesive material requires the applicator assembly to be destructively unsealed; and wherein the at least one sealed compartment comprises a first sealed compartment and a second sealed compartment, the first and second compartments being separated by a frangible barrier separating the first and second compartments, the polymerizable monomeric adhesive material being contained in the first compartment and the applicator being at least partially disposed in the second compartment.

33. A method of applying an adhesive material, comprising:

providing an applicator assembly according to claim 32;

moving the applicator to break the frangible partition separating the first and second compartments;

applying adhesive to the applicator;

removing the applicator from the applicator assembly; and applying the adhesive to a substrate to be bonded.

34. The method of claim 33, wherein the substrate to be bonded is tissue.

35. A single-use applicator assembly for dispensing and applying a polymerizable monomeric adhesive material, comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein the applicator assembly is destructively unsealed by removal of the applicator;

wherein the at least one sealed compartment comprises a first compartment and a second compartment, the first and second compartments being open to each other, the polymerizable monomeric adhesive material being contained in the first compartment and the applicator being at least partially disposed in the second compartment; and a plunger that defines the second compartment and that is movable into the first compartment to displace the adhesive material into the second compartment.

36. The applicator assembly according to claim 35, further comprising a polymerization initiator or accelerator for the adhesive material disposed in the second compartment.

37. The applicator assembly according to claim 36, wherein the polymerization initiator or accelerator is disposed in or on the tip of the applicator.

38. The applicator assembly according to claim 37, wherein the tip of the applicator is at least one of porous, absorbent and adsorbent in nature.

39. The applicator assembly according to claim 38, wherein the polymerization initiator or accelerator is absorbed or adsorbed into the tip of the applicator.

40. A method of applying an adhesive material, comprising:

providing an applicator assembly according to claim 35;

moving the plunger into the first compartment to displace the adhesive material into the second compartment such that adhesive is applied to the applicator;

removing the applicator from the second compartment; and applying the adhesive to a substrate to be bonded.

41. The method of claim 40, wherein the substrate to be bonded is tissue.

42. A kit comprising:

a plurality of associated single-use applicator assemblies for dispensing and applying a polymerizable monomeric adhesive material, each of the assemblies comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein the applicator assembly is destructively unsealed by removal of the applicator; and wherein a first of the assemblies comprises a greater amount of adhesive material than a second of the assemblies.

43. The kit of claim 38, further comprising a medicament contained in the at least one compartment.

44. The kit of claim 42, further comprising a polymerization initiator or accelerator for the adhesive material.

45. The kit of claim 42, wherein at least two of the assemblies are frangibly connected to each other.

46. A kit comprising:

a plurality of associated single-use applicator assemblies for dispensing and applying a polymerizable monomeric adhesive material, each of the assemblies comprising:

a base portion having at least one sealed compartment;

a polymerizable monomeric adhesive material contained in the at least one compartment;

an applicator at least partially disposed in the at least one compartment such that a tip of the applicator is proximate the polymerizable monomeric adhesive material; and a polymerization initiator or accelerator for the adhesive material;

wherein the applicator assembly is destructively unsealed by removal of the applicator; and wherein a first of the assemblies comprises a greater amount of polymerization initiator or accelerator than a second of the assemblies.

47. A kit comprising:

a plurality of associated single-use applicator assemblies for dispensing and applying a polymerizable monomeric adhesive material, each of the assemblies comprising:

a base portion having at least one sealed compartment;

a polymerizable monomeric adhesive material contained in the at least one compartment;

an applicator at least partially disposed in the at least one compartment such that a tip of the applicator is proximate the polymerizable monomeric adhesive material; and a polymerization initiator or accelerator for the adhesive material;

wherein the applicator assembly is destructively unsealed by removal of the applicator; and wherein a first of the assemblies comprises a larger sized tip of the applicator than a second of the assemblies.

48. A method of applying an adhesive material, comprising:

destructively opening an applicator assembly for dispensing and applying a polymerizable monomeric adhesive material, the applicator assembly comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein the applicator assembly is destructively unsealed by removal of the applicator;

removing the applicator from the at least one compartment; and applying the adhesive to a substrate to be bonded;

wherein the destructively opening step comprises at least partially separating a first part of the base portion from a second part of the base portion.

49. A method of applying an adhesive material, comprising:

destructively opening a single-use applicator assembly for dispensing and applying a polymerizable monomeric adhesive material, the assembly comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein the applicator assembly is destructively unsealed by removal applicator;

removing the applicator from the at least one compartment; and applying the adhesive to a substrate to be bonded;

wherein the destructively opening step comprises breaking at least a frangible barrier that seals the at least one compartment.

50. A method of applying an adhesive material, comprising:

destructively opening a single-use applicator assembly for dispensing and applying a polymerizable monomeric adhesive material, the assembly comprising:

a base portion having at least one sealed compartment;

a polymerizable monomeric adhesive material contained in the at least one compartment; and an applicator at least partially disposed in the at least one compartment such that a tin of the applicator is proximate the polymerizable monomeric adhesive material;

wherein removal of at least one of the applicator and the adhesive material requires the applicator assembly to be destructively unsealed; and wherein the base portion is formed from a material that stabilizes the polymerizable monomeric adhesive material;

removing the applicator from the at least one compartment; and directly applying the adhesive to a substrate to be bonded;

wherein the destructively opening step comprises at least partially separating a first part of the base portion from a second part of the base portion.

51. A method of applying an adhesive material, comprising:

destructively opening a single-use applicator assembly for dispensing and applying a polymerizable monomeric adhesive material, the assembly comprising:

a base portion having at least one sealed compartment;

a polymerizable monomeric adhesive material contained in the at least one compartment; and an applicator at least partially disposed in the at least one compartment such that a tip of the applicator is proximate the polymerizable monomeric adhesive material;

wherein removal of at least one of the applicator and the adhesive material requires the applicator assembly to be destructively unsealed; and wherein the base portion is formed from a material that stabilizes the polymerizable monomeric adhesive material;

removing the applicator from the at least one compartment; and directly applying the adhesive to a substrate to be bonded;

wherein the destructively opening step comprises breaking at least a frangible barrier that seals the at least one compartment.

* * * * *